US006413706B1

(12) United States Patent
Nakanishi et al.

(10) Patent No.: US 6,413,706 B1
(45) Date of Patent: Jul. 2, 2002

(54) DISPERSION OR MOLTEN PRODUCT OF WATER-INSOLUBLE PHOTOGRAPHICALLY USEFUL COMPOUNDS, PRODUCING METHOD THEREOF, COATING COMPOSITIONS AND SILVER HALIDE PHOTOGRAPHIC LIGHT-SENSITIVE MATERIAL USING THE SAME

(75) Inventors: Masatoshi Nakanishi; Hirokazu Saito, both of Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/568,806

(22) Filed: May 11, 2000

(30) Foreign Application Priority Data

May 11, 1999 (JP) ..... 11-130606
Nov. 2, 1999 (JP) ..... 11-312944

(51) Int. Cl.[7] ..... G03C 1/08; G03C 7/26; G03C 7/32

(52) U.S. Cl. ..... 430/546; 430/631; 430/935; 430/377; 430/449

(58) Field of Search ..... 430/546, 631, 430/935, 377, 449

(56) References Cited

U.S. PATENT DOCUMENTS 4,378,425 A * 3/1983 Schnoring et al. ..... 430/377
4,933,270 A 6/1990 Bagchi
4,957,857 A 9/1990 Chari
5,468,604 A * 11/1995 Zengerle et al. ..... 430/631
5,558,980 A * 9/1996 Nielson et al. ..... 430/546
5,817,450 A * 10/1998 Kawanishi et al. ..... 430/546
6,143,484 A * 11/2000 Schroeder et al. ..... 430/631

FOREIGN PATENT DOCUMENTS

JP 6308691 11/1994

* cited by examiner

*Primary Examiner*—Geraldine Letscher
(74) *Attorney, Agent, or Firm*—Birch, Stewart, Kolasch & Birch, LLP

(57) ABSTRACT

There is disclosed a method for producing an aqueous dispersion of a water-insoluble photographically useful compound, by mixing a composition containing at least one water-insoluble photographically useful organic compound with an aqueous medium, and finely dividing the mixture into particulates by a super-high-pressure homogenizer at 180 MPa (1800 bar) or higher. According to the method, the aqueous dispersion of the water-insoluble photographically useful compound can be produced without using a low-boiling solvent, with excellent energy efficiency and in a simple step. Further, there is also disclosed a silver halide photographic light-sensitive material utilizing the dispersion.

28 Claims, 3 Drawing Sheets

DISPERSION OR MOLTEN PRODUCT OF WATER-INSOLUBLE PHOTOGRAPHICALLY USEFUL COMPOUNDS, PRODUCING METHOD THEREOF, COATING COMPOSITIONS AND SILVER HALIDE PHOTOGRAPHIC LIGHT-SENSITIVE MATERIAL USING THE SAME

FIELD OF THE INVENTION

The present invention relates to a particulate dispersion or a molten product of a water-insoluble photographically useful compound, a producing method thereof, and a silver halide light-sensitive material using the same.

BACKGROUND OF THE INVENTION

As a water-insoluble photographically useful compound used in the present invention, for example, dye-image-forming couplers, dye-image-providing redox compounds, stain inhibitors, antifoggants, ultraviolet absorbers, anti-fading agents, color mixing prevention agents, nucleating agents, silver halide solvents, bleach accelerators, developing agents, filter dyes and precursors thereof, dyestuffs, pigments, sensitizers, hardeners, whitening agents, desensitizers, antistatic agents, antioxidants, scavengers for oxidized developing agents, mordants, matte agents, development accelerators, development inhibitors, thermal solvents, color-tone-adjusting agents, lubricant and polymer latexes for dispersion, which are used as a medium for dispersing thereof, water-insoluble inorganic salts (such as zinc hydroxide), and membrane strength improvers, can be mentioned. Such water-insoluble photographically useful compounds are generally emulsified or dispersed into solid fine particles by mechanical force as oil-in-water dispersions (emulsions) or solid fine particles dispersions that are dispersed in water or hydrophilic colloid, and these dispersions are used for photographic emulsion layers or other layers. The above water-insoluble photographically useful compounds are described, for example, in Research Disclosure (R. D.) Nos. 17643, 18716, 307105, and 40145.

As the emulsifying method, agitation by an impeller, and milling by the use of a colloid mill, are generally used. Further, a method utilizing supersonic waves may also be employed. Such methods involve problems that only a portion of the given energy can be utilized for the dispersion, and sufficient fineness cannot be achieved. Further, there are methods, wherein colliding a liquid flow under pressure against a wall, or colliding liquid flows against each other, thereby dispersing the material finely by impact shocks or shearing forces, as in a Manton-Gaulin homogenizer. Such methods involve problems that only a portion of the given energy can be utilized for the dispersion, since dispersion is conducted generally only upon collision; the machine components are liable to be abraded, and a finer dispersion can not be attained. Further, use of a high-pressure homogenizer is disclosed, as in JP-A-6-308691 ("JP-A" means an unexamined published Japanese patent application), but no sufficient fine dispersion can yet be attained.

Media milling is generally used as a method to obtain a dispersion in a form of solid fine particles. The method involves problems that only a portion of the given energy can be utilized for the dispersion, and it takes much time. to make a fine dispersion.

Further, as described, for example, in U.S. Pat. Nos. 4933207 and 4957857, a method for precipitating a dispersion from a homogeneous system has been proposed, but it involves problems that salts or water miscible organic solvents have to be removed, the productivity is poor because of complicated steps, and the applicable range to the materials is limited, and, accordingly, the method has not yet been generally used. Further, a method for dividing all droplets by a porous membrane has been proposed, but this results in a problem of causing clogging or coalescence when used for a long period of time.

If the energy can be used effectively for the dispersion, it will lead to decrease in the usage of petroleum fuels and thus will help preserve the global environment.

As an example of water-insoluble photographically useful compounds, a dye-image-forming coupler can be mentioned. Usually, for photographic use, a dye-image-forming coupler, a high-boiling organic solvent (having a boiling point above 160° C., and preferably above 175° C. or more), and, to impart solubility, a low-boiling organic solvent (having a boiling point from 30 to 160° C.), are mixed into a solution, and the composition and a hydrophilic colloidal solution are emulsified in the presence of a surfactant. However, since a low-boiling organic solvent is used, it is released in the environment, and requires equipment and energy to recover it. Considering mitigation of loads on the environment, and improvement of productivity, it is desirable to decrease the use of a low-boiling organic solvent. Further, as mentioned above, a surfactant is often used together as a dispersion aid. However, in conventional methods, a relatively great amount of a surfactant is used against a material to be dispersed, which results in problems, such as deterioration of the stability of the dispersion with lapse of time, formation of bubbles during the production steps or in the developing solution or waste water, an increase of viscosity when mixed with a hydrophilic colloid, and change of the photographic properties of a light-sensitive material using the same during storage.

SUMMARY OF THE INVENTION

An object of the present invention is to provide a method capable of producing an aqueous dispersion of a water-insoluble photographically useful compound at high energy efficiency, in a relatively simple step and without using a low-boiling solvent; a method capable of producing the aqueous dispersion with a reduced amount of a surfactant; as well as a method for producing a finer dispersion of a water-insoluble photographically useful compound under such conditions; dispersions obtained thereby; a coating composition containing the dispersion; and a silver halide photographic light-sensitive material using the same.

Other and further objects, features, and advantages of the invention will appear more fully from the following description, taken in connection with the accompanying drawings.

DETAILED DESCRIPTION OF THE INVENTION

Figure 1:
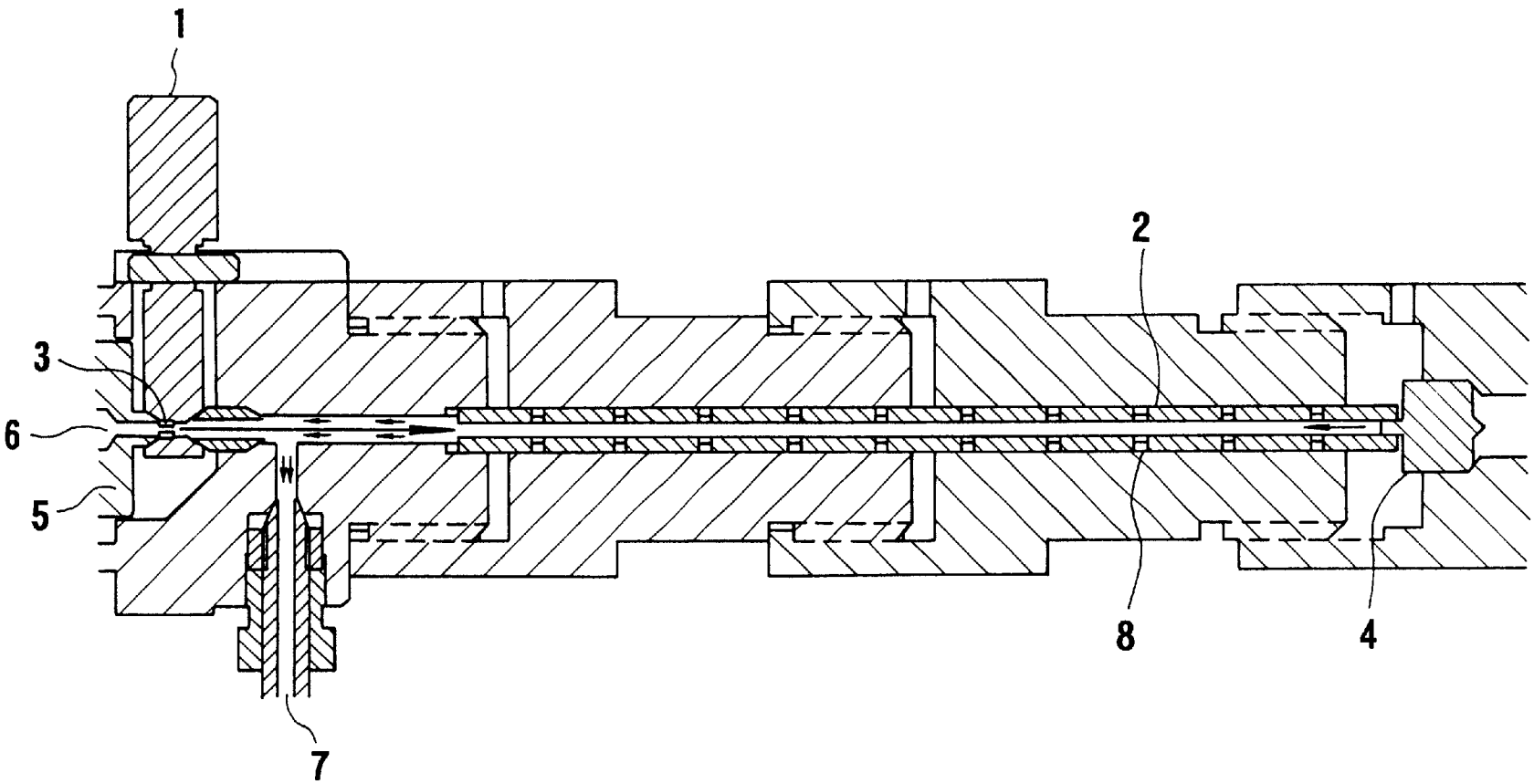
FIG. 1 is a schematic view of a dispersion cell in a dispersing device, in which a liquid before dispersion is increased in pressure by a high pressure pump, entered from an inlet and jetted from a nozzle into an absorption cell as a jet stream, and the direction of the jet stream is reversed.

As a result of earnest studies, the present inventors have found that the foregoing objects can be accomplished by the following means. That is, according to the present invention, there are provided:

(1) A method for producing an aqueous dispersion of a water-insoluble photographically useful compound, which comprises mixing a composition containing at least one water-insoluble photographically useful organic compound, with an aqueous medium, and then dividing the compound into particulates by a super-high-pressure homogenizer at 180 MPa (1800 bar) or higher;

(2) The method for producing an aqueous dispersion of a water-insoluble photographically useful compound as described in the above (1), wherein the compound is divided into particulates in a super-high-pressure jet stream;

(3) The method for producing an aqueous dispersion of a water-insoluble photographically useful compound as described in the above (2), wherein an initial velocity of the super-high-pressure jet stream is 400 m/sec or higher;

(4) The method for producing an aqueous dispersion of a water-insoluble photographically useful compound as described in the above (2), wherein an initial velocity of the super-high-pressure jet stream is 600 m/sec or higher;

(5) The method for producing an aqueous dispersion of a water-insoluble photographically useful compound as described in any one of the above (1) to (4), wherein the aqueous dispersion of the water-insoluble photographically useful compound is substantially free from a water-miscible or low-boiling organic solvent, at a time immediately after completion of particulate formation step but before other subsequent steps;

(6) The method for producing an aqueous dispersion of a water-insoluble photographically useful compound as described in any one of the above (2) to (5), wherein the composition and the aqueous medium are mixed and dispersed in the jet stream;

(7) The method for producing an aqueous dispersion of a water-insoluble photographically useful compound as described in any one of the above (2) to (6), wherein the composition of the water-insoluble photographically useful compound is a molten product formed by mixing the water-insoluble photographically useful compound and a high-boiling organic solvent in the same super-high-pressure jet stream as described above, and the water-insoluble photographically useful compound is dissolved in the high-boiling organic solvent;

(8) The method for producing an aqueous dispersion of a water-insoluble photographically useful compound as described in any one of the above (2) to (7), wherein the pressure for forming the jet stream is 210 MPa (2100 bar) or higher;

(9) The method for producing an aqueous dispersion of a water-insoluble photographically useful compound as described in any one of the above (2) to (7), wherein the pressure for forming the jet stream is 300 MPa (3000 bar) or higher;

(10) The method for producing an aqueous dispersion of a water-insoluble photographically useful compound as described in any one of the above (1) to (9), wherein the melting point of the mixture of multiple water-insoluble photographically useful compounds, except for the high-boiling organic solvent and the dispersion aid, is lower by 2° C. or more than the mass weighted mean of the melting points of the respective compounds;

(11) The method for producing an aqueous dispersion of a water-insoluble photographically useful compound as described in any one of the above (1) to (10), wherein the aqueous medium contains a water-soluble protective colloid;

(12) The method for producing an aqueous dispersion of a water-insoluble photographically useful compound as described in any one of the above (1) to (11), wherein the dispersion contains a surfactant;

(13) The method for producing an aqueous dispersion of a water-insoluble photographically useful compound as described in the above (12), wherein the surfactant is used in an amount of 3% by weight or less, based on the water-insoluble photographically useful compound or a mixture of the compound and the high-boiling organic solvent;

(14) The method for producing an aqueous dispersion of a water-insoluble photographically useful compound as described in the above (12), wherein the surfactant is used in an amount of 1% by weight or less, based on the water-insoluble photographically useful compound or a mixture of the compound and the high-boiling organic solvent;

(15) An aqueous dispersion of a water-insoluble photographically useful compound that is the dispersion obtained by the method for producing a water-insoluble photographically useful compound as described in any one of the above (1) to (14);

(16) The aqueous dispersion of a water-insoluble photographically useful compound as described in the above (15), wherein an average particle size of the aqueous dispersion of the water-insoluble photographically useful compound is 0.01 $\mu$m or less;

(17) A method for producing a molten product of a water-insoluble photographically useful compound, which comprises mixing and dissolving a water-insoluble photographically useful compound and a high-boiling organic solvent in a super-high-pressure jet stream.

(18) A coating composition for use in a silver halide photographic light-sensitive material, which uses the aqueous dispersion of the water-insoluble photographically useful compound as described in the above (15) or (16);

(19) A silver halide photographic light-sensitive material, which uses the aqueous dispersion of the water-insoluble photographically useful compound as described in the above (15) or (16);

(20) A silver halide photographic light-sensitive material, the material has, on a support, at least one layer obtained by coating a coating composition, which coating composition is formed by preparing an aqueous dispersion of the water-insoluble photographically useful compound as described in the above (15) or (16), and then mixing the dispersion rapidly after preparation, with remaining coating ingredients;

(21) The silver halide photographic light-sensitive material as described in the above (20), wherein the at least one layer of the coating composition is coated on a support, without retention of time over 20 minutes from its preparation.

The term "water-insoluble" referred to in the present invention, means that when a required amount of a photographically useful compound is added to a photographic element, the compound can not be added entirely as an aqueous solution into a coating composition, even if the coating composition is diluted to a limit concentration within an applicable range, owing to the insufficient water solubility. Usually, the term "water-insoluble" is used for a compound having solubility to 100 g of water at 20° C. of 10 or less, preferably, 5 or less.

The water-insoluble photographically useful compound that can be used in the present invention may include, for example, dye-image-forming couplers, dye-image-providing redox compounds, stain inhibitors, antifoggants, ultraviolet absorbers, anti-fading agents, color mixing prevention agents, nucleating agents, silver halide solvents, bleach accelerators, developing agents, filter dyes and precursors thereof, dyestuffs, pigments, sensitizers, hardeners, whitening agents, desensitizers, antistatic agents, antioxidants, scavengers for oxidized developing agents, mordants, matte agents, development accelerators, development inhibitors, thermal solvents, color-tone-adjusting agents, lubricants and polymer latexes for dispersion, which are used as a medium for dispersing thereof, water-insoluble inorganic salts (such as zinc hydroxide), and membrane strength improvers. The compounds are described, for example, in Research Disclosure (R. D.) Nos. 17643, 18716, 307105, and 40145.

In the composition treated in the present invention, there is no particular restriction on the ratio of the water-insoluble photographically useful organic compound, but it is, preferably, 1% by weight or more, more preferably, 2 to 50% by weight and, particularly preferably, 5 to 20% by weight in concentration.

In the present invention, in a case where a molten product is prepared by dissolving a water-insoluble photographically useful compound into a high-boiling organic solvent in a dispersion cell at a preceding stage, and then the product is dispersed into an aqueous medium in a dispersion cell at a succeeding stage, there is no particular restriction on the amount of the high-boiling organic solvent for preparing the molten product, and the amount may be a sufficient amount to disperse and stabilize the water-insoluble photographically useful compound at least in an aqueous dispersion formed after the treatment in the latter stage, and to allow the photographically useful compound to exhibit satisfactory properties, such as color formation, discoloration, and immobilization.

The method according to the present invention can be practiced suitably by using a dispersing device shown in FIG. 1.

FIG. 1 is a cross sectional view of a dispersion cell in a dispersing device, in which a nozzle 1 has an orifice at a tip end. The diameter of the orifice 3 can be selected arbitrary within a range from 0.1 mm to 0.2 mm. It is, for example, made of zirconia. A cell, which is called an absorption cell 2, has 0.5 to 1 mm inner diameter (selected optionally) and 1 cm length, and which is made, for example, of zirconia; and cells each of such constitution are preferably connected in plurality. A seal 8 made of PEEK (polyether ether ketone) that has a larger inner diameter than that of the absorption cell is provided between each of the cells to form a recess. In the drawing, are also shown a plug 4 to reverse the liquid, a coupling 5 to make the liquid into a laminar or turbulent flow, an inlet 6 for the liquid before dispersion, and an outlet 7 for the liquid after dispersion.

The liquid before dispersion is increased in pressure by a high-pressure pump, enters through the inlet 6 and intrudes from the nozzle as shown by an arrow as a jet stream into the section of absorption cell 2*s*. Generally, the jet stream is defined as a state of a flow jetted out from a small-diameter hole, at a high speed with a narrow width.

The jet stream is reversed its direction by the liquid reversing plug 4, and it returns along the outside of the fluid jetted from the nozzle. Shearing force is created between forwarding and backwarding liquid flows to cause dispersion or emulsification. Further, mixing occurs in the recess at the seal 8 in the cell (refer to latter explanation for FIG. 3). A back pressure may be applied to the outlet.

For the device shown in FIG. 1, the treating liquid intended to be dispersed is preferably used after coarsely being dispersed by a dissolver or a colloid mill.

Figure 2:
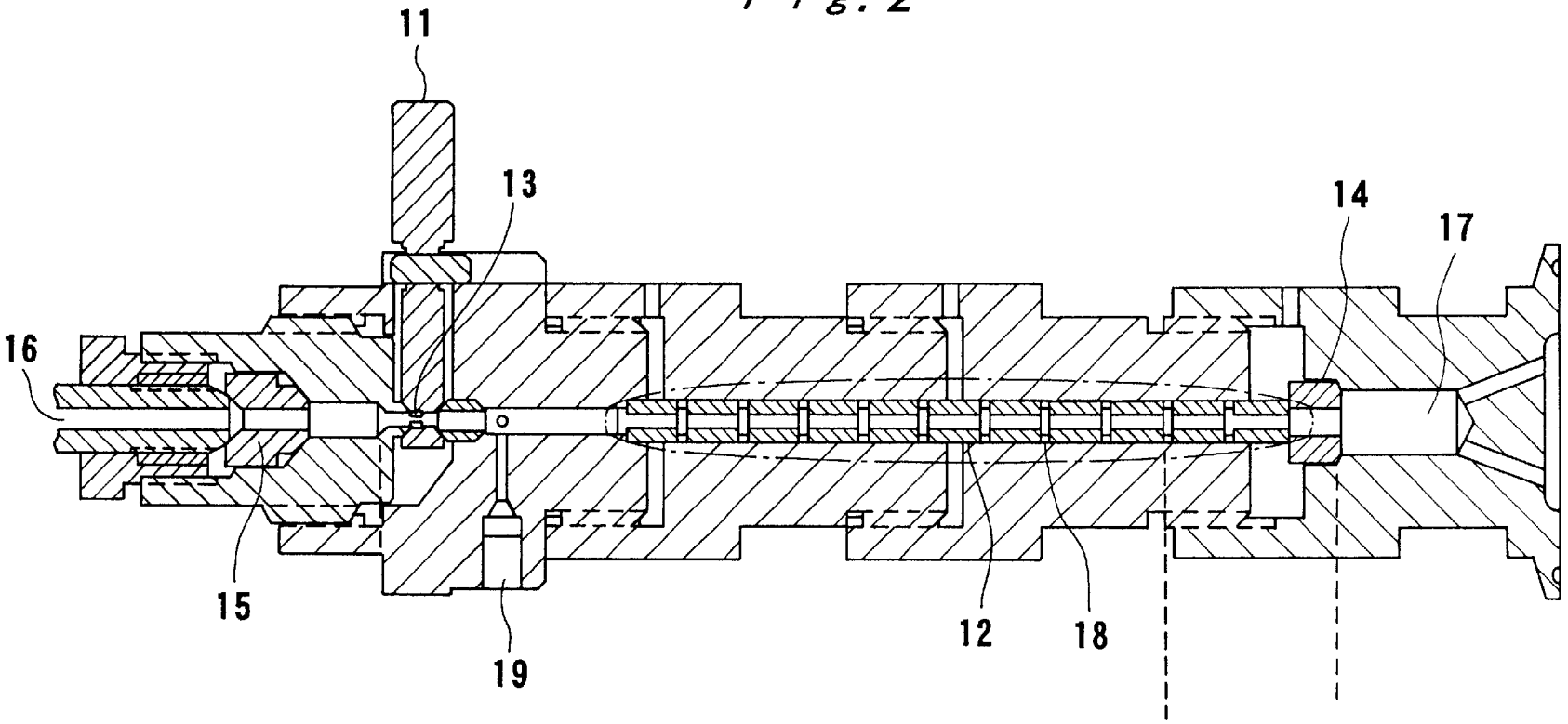
FIG. 2 is a schematic view of a dispersion cell in a dispersing device, in which a liquid before dispersion is increased in pressure by a high pressure pump, entered from an inlet and jetted from a nozzle into an absorption cell as a jet stream, while being mixed with a composition, powder material, or other liquid.

The method according to the present invention can also be practiced suitably by using a dispersing device shown in FIG. 2. FIG. 2 is a cross sectional view of a dispersion cell in a dispersing device, in which a nozzle 11 has an orifice at a tip end. The diameter of the orifice 13 can be selected arbitrary within a range from 0.1 mm to 0.2 mm. It is, for example, made of zirconia. An absorption cell 12 has 0.5 to 1 mm inner diameter (selected optionally) and 1 cm length, which is also made, for example, of zirconia, and cells each of such constitution are preferably connected in plurality. A seal 18 that has a larger inner diameter than that of the absorption cell is provided between each of the cells to form a recess. Reference numeral 14 is a plug and the liquid flows rightward with no reversion. In the drawing, are also shown a coupling 15 to make the liquid into a laminar or turbulent flow, an inlet 16 for the liquid before dispersion, and an outlet 17 for the liquid after dispersion. An inlet 19 is to introduce a composition or powder material (or other liquid) to be mixed with the liquid introduced from the liquid inlet 16. Generally, a powder material introducing device such as a pump or a hopper is attached to the inlet to introduce the liquid or powder material.

Figure 3:
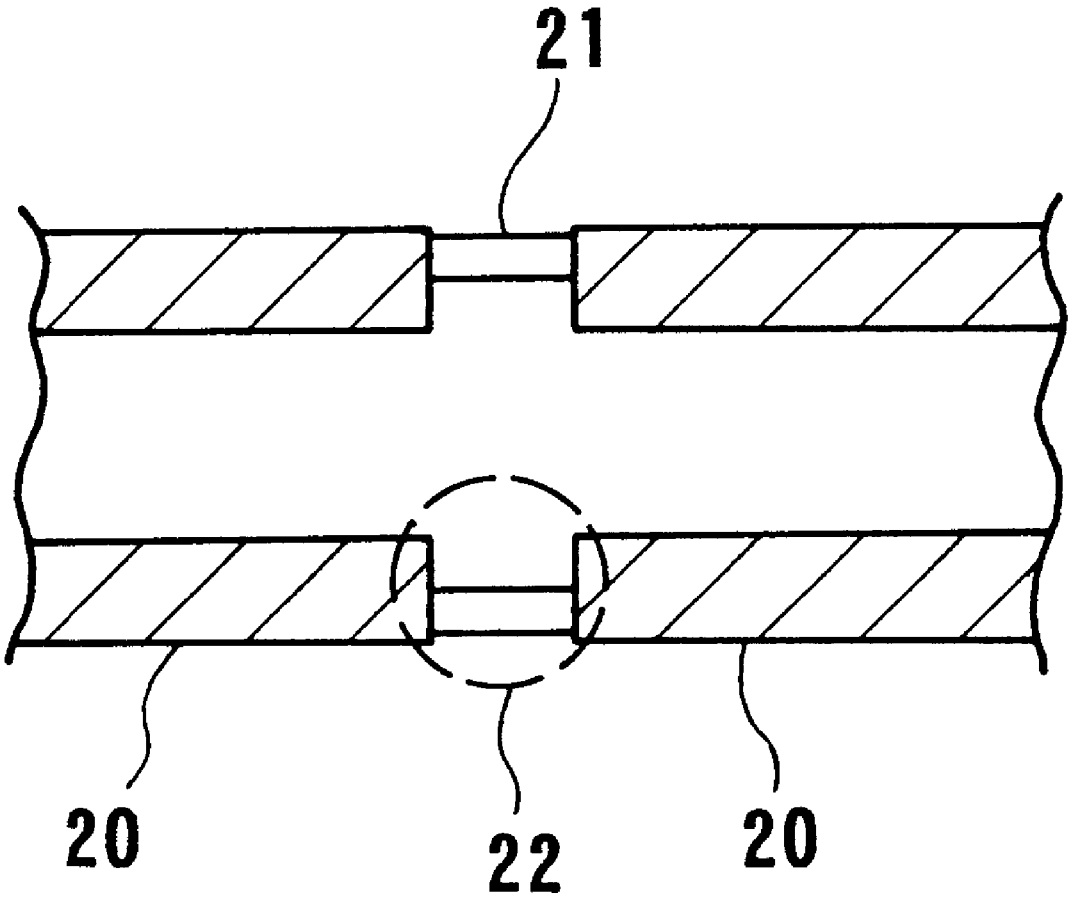
FIG. 3 is an enlarged view of a portion 8 or 18 in FIG. 2.

FIG. 3 shows an enlarged view for the recess 8 or 18 shown in FIG. 1 or FIG. 2 respectively. In the drawing, are shown absorption cell 20*s*, a PEEK seal 21 and a recess 22.

The liquid dispersion is increased in pressure in a high pressure pump, and it enters from the inlet and intrudes as a jet stream from the nozzle into the absorption cells. The jet stream causes shearing force, at the inner wall of the cell and in the recess of the seal portion, to cause dispersion, mixing, and emulsification.

A back pressure is preferably applied to the outlet.

By the use of the dispersion cell shown in FIG. 2, an aqueous colloid solution and a water-insoluble composition including a coupler can be introduced from different inlets of the cell, and they can be dispersed without previously dispersing them coarsely.

In FIG. 1 and FIG. 2, the dispersing liquid and the composition can be introduced at arbitrary temperatures, as long as the temperature is within a range that does not cause decomposition or vaporization. Further, the dispersing liquid can be cooled to an arbitrary temperature as long as the temperature is within a range that does not cause freezing or the like, by applying a jacket to the periphery of the cell to flow a refrigerant, or by employing a heat exchanger after dispersion.

The dispersion cell shown in FIG. 1 or the dispersion cell shown in FIG. 2 can be further connected to the outlet of the cell shown in FIG. 2. When two dispersion cells of FIG. 2 are connected, it is possible to introduce a high-boiling organic solvent from the inlet 16 of the preceding dispersion cell, and a coupler powder material from the inlet 19 of the preceding dispersion cell, which are mixed and dissolved into a molten product, under a high pressure, in the first cell; and it is possible to introduce an aqueous colloid solution from the inlet 19 of the second dispersion cell, and emulsify them in the second dispersion cell or the dispersion cell at the downstream. This enables emulsification with reduced amount of the low-boiling organic solvent, without previously conducting a dissolving step or coarse dispersion step to prepare a composition of a coupler and a high-boiling organic solvent with using a low-boiling organic solvent. Furthermore, melting can be made completely by returning the molten product exited from the outlet of the preceding dispersion cell, through a tank or the like, into the inlet 16 again. A mesh or filter may be provided in a midway of the pipeline. Further, if the compound is aerially oxidized easily, the pipeline may be filled with the dissolved solution, or the atmosphere may be replaced with nitrogen. The high-boiling organic solvent or the molten product can be heated. Heat melting by the use of microwaves can be also used in combination.

A plurality of inlets can also be provided in the midway of the dispersion cell, and a plurality of water-insoluble compounds and high-boiling organic solvents can be mixed and dissolved.

DeBEE2000 (trade name) manufactured by BEE INTERNATIONAL Co. can be mentioned, for example, as such a dispersion device.

In the present invention, a super-high pressure is applied at the liquid inlet (6 or 16) of the homogenizer.

The dispersion liquid is preferably presurized at a constant pressure 180 MPa (1800 bar) or higher. More preferably, it is pressurized at a constant pressure 210 MPa (2100 bar) or higher and, further preferably, 300 MPa (3000 bar) or higher. Further, the initial velocity of the jet stream is preferably a flow rate at 300 m/sec or higher and, more preferably, 400 m/sec or higher and, further preferably, 600 m/sec or higher. The jet stream in the present invention means a liquid stream.

The state "not substantially containing water-miscible or low-boiling organic solvent" in the present invention, means that the concentration of such solvent in the dispersion is 3% or lower, preferably, 1% or lower and, further preferably, 0.1% or lower (each percentage for composition represents weight % here and hereinafter).

For the coupler and the high-boiling organic solvent used in the present invention, high solubility of the former into the latter is preferred. The melting point of the coupler is preferably 155° C. or lower, more preferably, 125° C. or lower, and further preferably, 100° C. or lower at 1 atm. A technique of using a plurality of couplers and lowering the melting point by using the melting point lowering effect to improve the solubility is preferably used. In the present invention, the melting point for the mixture of a plurality of water-insoluble photographically useful compounds, except for the high-boiling organic solvent and the dispersion aid, is preferably lower than the mass weighted mean value of the melting point of each of the compounds by more than 2° C., more preferably, by more than 4° C.

The aqueous medium according to the present invention preferably contains a water-soluble protective colloid. As the protective colloid, known compounds can be used, and they can include, for example, polyvinyl alcohol, polyethylene oxide, polyvinyl pyrrolidone, polyacrylic acid, polyacryl amide, polysaccharides, casein and gelatin. Gelatin is particularly preferred.

The aqueous dispersion of the water-insoluble photographically useful compound for use in the present invention preferably contains a surfactant. Known surfactants can be used. Examples of conventionally disclosed dispersion aids can include anionic dispersants, such as alkylphenoxyethoxyethanesulfonic acid salt, polyoxyethylene alkylphenylethersulfonic acid salt, alkylbenzenesulfonic acid salt, alkylnaphthalenesulfonic acid salt, alkylsulfuric acid ester salt, alkyl sulfosuccinic acid salt, sodium oleylmethyltauride, formaldehyde condensation product of naphthalenesulfonic acid, polyacrylic acid, polymethacrylic acid, maleic acid/acrylic acid copolymer, carboxymethylcellulose, and sulfuric acid cellulose; nonionic dispersants, such as polyoxyethylenealkyl ether, sorbitan fatty acid ester, polyoxyethylenesorbitan fatty acid ester, and polyalkyleneoxide block polymer; cationic dispersants; and betain-series dispersants. In the prior art, the dispersion aids were often used at 5 to 40% by weight ratio, based on the material to be dispersed (i.e. based on the total of the water-insoluble photographically useful compound and the high-boiling organic solvent if the high-boiling organic solvent is used, or based on the water-insoluble photographically useful compound if the solvent is not used). However, excessive use of the surfactant results in problems, such that the stability over time of the dispersion is deteriorated, bubbling is caused during production step or in developer solution or liquid wastes, the viscosity increases upon mixing with the hydrophilic colloid, and the photographic properties of the light-sensitive material using the compound is deteriorated during storage. The amount of the surfactant to be used can be decreased by the use of the dispersing method according to the present invention. The amount of the surfactant to the material to be dispersed (i.e. the total of the water-insoluble photographically useful compound and the high-boiling organic solvent if the high-boiling organic solvent is used, or the water-insoluble photographically useful compound if the solvent is not used) is preferably 3% by weight or less, more preferably, 1% by weight or less and, further preferably, 0.5% by weight or less.

The average particle size of the dispersed particles in the aqueous dispersion of the water-insoluble photographically useful compound according to the present invention is preferably 0.002 $\mu$m or more, but 0.1 $\mu$m or less.

When the particle size is small, the amount of use to be required can be decreased by activity of a coupler and covering power of a dispersing dye.

To provide a layer containing the aqueous dispersion of the water-insoluble photographically useful compound to make a photographic light-sensitive material, it can be achieved by dispersing the thus obtained dispersion in an appropriate binder to prepare a substantially uniform coating composition, and then coating the composition on a desired support.

There is no particular restriction on the binder, as long as it is a hydrophilic colloid, which can be used in a light-sensitive emulsion layer or a non-light-sensitive layer, and gelatin or a synthetic polymer, such as polyvinyl alcohol and polyacryl amide is generally used.

For the coating composition, it is preferred that the prepared dispersion be rapidly mixed with other coating ingredients, and coated within a residence time of 20 min after mixing. In this process, even a dispersion, which is unstable in a dispersed state and tends to cause coagulation or change of particle size, after preparation, can be taken into the coating film with no substantial deterioration. For promoting mixing with other coating ingredients, it is preferred to directly mix a liquid flow going out from the liquid outlet of the dispersing device with a liquid flow of other coating ingredients in-line, without storage, for example, by using a static mixer. The mixing is conducted within generally 10 minutes, preferably, within 5 minutes and, more preferably, within 1 minute after the preparation. As an example of defining the time from the preparation up to the coating of the coating composition, JP-A-3-223839 can be mentioned.

The dispersion of the water-insoluble photographically useful compound and the coating composition prepared by the method according to the present invention, are contained in a light-sensitive colloid layer or a non-light-sensitive hydrophilic colloid layer in a silver halide photographic light-sensitive material and, in a light-sensitive material, in which a plurality of such layers are provided, the dispersion and coating composition may be contained in such a plurality of layers.

Examples of these silver halide light-sensitive materials include an X ray light-sensitive film, a film for printing, a black-and-white negative film, a color negative film, a color reversal film, a motion picture film, a color paper, and the like.

As various techniques, or inorganic or organic materials, that can also be used for the silver halide photographic light-sensitive material in the present invention, generally those described in the Research Disclosure No. 308119 (1989) can be used. In addition to the above, techniques or inorganic or organic materials that can be used in the silver halide photographic light-sensitive material of the present invention, are described in the below points of Published EP-A-436,938 (A2) and in the below-referred patent publications.

| Item | Corresponding section |
|---|---|
| 1) Layer structures | page 146, line 34 to page 147, line 25 |
| 2) Silver halide emulsions | page 147, line 26 to page 148, line 12 |
| 3) Yellow couplers | page 137, line 35 to page 146, line 33, and page 149, lines 21 to 23 |
| 4) Magenta couplers | page 149, lines 24 to 28; and EP-A-421,453 (A1), page 3, line 5 to page 25, line 55 |
| 5) Cyan couplers | page 149, lines 29 to 33; and EP-A-432,804 (A2), page 3, line 28 to page 40, line 2 |
| 6) Polymer couplers | page 149, lines 34 to 38; and EP-A-435,334 (A2), page 113, line 39 to page 123, line 37 |
| 7) Colored couplers | page 53, line 42 to page 137, line 34, and page 149, lines 39 to 45 |
| 8) Other functional couplers | page 7, line 1 to page 53, line 41, and page 149, line 46 to page 150, line 3; and EP-A-435,334 (A2), page 3, line 1 to page 29, line 50 |
| 9) Antiseptics and mildewproofing agents | page 150, lines 25 to 28 |
| 10) Formalin scavengers | page 149, lines 15 to 17 |
| 11) Other additives | page 153, lines 38 to 47; and EP-A-421,453 (A1), page 75, line 21 to page 84, line 56, and page 27, line 40 to page 37, line 40 |
| 12) Dispersion methods | page 150, lines 4 to 24 |
| 13) Supports (Bases) | page 150, lines 32 to 34 |
| 14) Film thickness and film physical properties | page 150, lines 35 to 49 |

-continued

| Item | Corresponding section |
|---|---|
| 15) Color development/black-and-white development/fogging steps | page 150, line 50 to page 151, line 47; and EP-A-442,323 (A2), page 34, lines 11 to 54, and page 35, lines 14 to 22 |
| 16) Desilvering steps | page 151, line 48 to page 152, line 53 |
| 17) Automatic processors | page 152, line 54 to page 153, line 2 |
| 18) Washing/stabilizing steps | page 153, lines 3 to 37 |

According to the method for producing an aqueous dispersion as defined in (1) to (14) of the present invention, an aqueous dispersion of a water-insoluble photographically useful compound with remarkably small average particle size can be prepared while saving or reducing to zero the use amount of a low-boiling solvent and a surfactant, and with a high energy efficiency. Further, a powder material of a water-insoluble photographically useful compound can be formed into a stable aqueous dispersion.

Then, the aqueous dispersions in (15) and (16) and the coating composition for use in the light-sensitive material in (18) have small average particle size of the water-insoluble photographically useful compound and have high storage stability. Accordingly, the light-sensitive material as defined in (19) to (21), which uses the aqueous dispersion, can decrease the amount of a dye to be used and can improve the whiteness in the white background by the improved activity of a coupler and increased covering power of a dispersion dye. Further, the light-sensitive material, particularly, in (20), (21) can provide higher coupler activity. Further, according to the method as defined in (17), a molten product of the water-insoluble photographically useful compound that can be used in the production method in (1) to (14) and easily dispersible as an aqueous dispersion, can be prepared in a relatively simple step.

Now, the present invention is described in more detail with reference to the following examples, but the present invention is not limited thereto.

EXAMPLES

Example 1

(Preparation of Comparison Dispersions 1-1, 1-2, and Invention Dispersions 1-1 to 1-5)

An aqueous medium 1-1 was prepared by dissolving 715 g of gelatin, 5 g of sodium dodecylbenzenesulfonate, and 855 g of water at 40° C. 110 g of coupler-1, 32 ml of tricresyl phosphate, and 115 ml of ethyl acetate were mixed and dissolved at 60° C. to form Composition 1-1. The aqueous medium 1-1 and Composition 1-1 were mixed, and stirred by a dissolver, to obtain a coarse liquid dispersion 1-1. A coarse liquid dispersion 1-2 was obtained in the same manner as in the treatment of the coarse liquid dispersion 1-1, except that coupler-1 and ethyl acetate were not added. In the subsequent examples including this example, a coupler or a dye as a powder material, before dispersion, is in a flake or wet cake-like form (water content: about 17.6 wt %), not a particulate form. Further, in this example and the subsequent examples, the mixed compositional ratio for each of the ingredients is identical with that described in the introductory part of each working examples, unless otherwise specified, and the results are results of tests on the dispersions prepared by different dispersion methods with using the same composition.

Comparison Dispersion 1-1

The coarse liquid dispersion 1-1 was finely divided into particulates in a dissolver, and ethyl acetate was removed under a reduced pressure.

Invention Dispersion 1-1

The coarse liquid dispersion 1-1 heated to 40° C. was introduced in the dispersion cell shown in FIG. 1, passed for once, and cooled. The pressure was 210 MPa (2100 bar).

Invention Dispersion 1-2

In the constitution of a dispersion cell, in which the inlet 6 of the dispersion cell shown in FIG. 1 was connected to the outlet 17 of the dispersion cell shown in FIG. 2, the aqueous medium 1-1 heated to 40° C. was introduced from the inlet 16, and the composition 1-1 heated to 60° C. was introduced from the inlet 19 respectively, passed for once, and cooled. The pressure was 210 MPa (2100 bar).

Invention Dispersion 1-3

In the constitution of a dispersion cell, in which the inlet 6 of the dispersion cell shown in FIG. 1 was connected to the outlet 17 of the dispersion cell shown in FIG. 2, the coarse liquid dispersion 1-2 heated to 60° C. was introduced from the inlet 16, and coupler-1 as a powder material was introduced from the inlet 19 through a hopper respectively, passed for once, and cooled. The pressure was 210 MPa (2100 bar).

Invention Dispersion 1-4

In the constitution of a dispersion cell, in which the outlet 17 of the dispersion cell shown in FIG. 2 was connected with the inlet 16 of another dispersion cell shown in FIG. 2, and the inlet 6 of the cell shown in FIG. 1 was further connected to the second outlet 17 of the dispersion cell shown in FIG. 2, tricresyl phosphate heated to 60° C. was introduced from the inlet 16 of the preceding dispersion cell, the powder material coupler-1 was introduced from the preceding inlet 19, and the aqueous medium 1-1 heated to 60° C. was introduced from the second inlet 19 of the dispersion cell, respectively, and they were passed for once, and cooled. The pressure was 210 MPa (2100 bar).

Invention Dispersion 1-5

The procedure was the same as for the preparation of Invention Dispersion 1-1, except that the pressure was changed to 300 MPa (3000 bar).

Comparison Dispersion 1-2

The procedure was the same as for the preparation of Invention Dispersion 1-1, except that the pressure was changed to 170 MPa (1700 bar).

Comparison Dispersion 1-3

The coarse liquid dispersion 1-1 heated to 40° C. was passed through a MICROFLUIDIZER EH110 (trade name, manufactured by Mizuho Kogyo Co.) for three times at a pressure 170 MPa (1700 bar), and cooled.

The introduction amount for each of dispersion was controlled such that all of them had an identical composition.

Evaluation of the Stability of the Dispersion

The average particle size of the dispersion was measured before and after heating at 40° C. for one day, by using LA920 (trade name) manufactured by Horiba Seisakusho Co. The results are shown in Table 1. The dispersions according to the present invention were made stable, since they were finely dispersed and prepared without using low-boiling organic solvent.

TABLE 1

| Sample | Pressure (bar) [MPa] | Average particle size (μm) Immediately after preparation | After 1 day storage at 40° C. |
|---|---|---|---|
| Comparison Dispersion 1-1 | — | 0.22 | 0.30 |
| Invention Dispersion 1-1 | 2100 [210] | 0.11 | 0.15 |
| Invention Dispersion 1-2 | 2100 [210] | 0.09 | 0.13 |
| Invention Dispersion 1-3 | 2100 [210] | 0.08 | 0.08 |
| Invention Dispersion 1-4 | 2100 [210] | 0.07 | 0.07 |
| Invention Dispersion 1-5 | 3000 [300] | 0.09 | 0.13 |
| Comparison Dispersion 1-2 | 1700 [170] | 0.20 | 0.37 |
| Comparison Dispersion 1-3 | 1700 [170] | 0.20 | 0.37 |
| Comparison Dispersion 2-1 | — | 0.21 | 0.26 |
| Invention Dispersion 2-1 | 2100 [210] | 0.04 | 0.04 |
| Comparison Dispersion 2-2 | — | 0.22 | 0.28 |
| Invention Dispersion 2-2 | 2100 [210] | 0.05 | 0.05 |

Example 2

(Preparation of Comparison Dispersions 2-1 and 2-2, and Invention Dispersions 2-1 and 2-2)

Comparison Dispersion 2-1

An aqueous medium 2-1 was prepared by dissolving 100 g of gelatin, 3.3 g of sodium dodecylbenzenesulfonate, and 742 g of water at 40° C. 59 g of coupler-2, 35 ml of tricresyl phosphate, and 115 ml of ethyl acetate were mixed, and dissolved at 60° C., to form a composition 2-1. The aqueous medium 2-1 and the composition 2-1 were mixed, and finely divided into particulates by a dissolver, and ethyl acetate was removed under a reduced pressure.

Invention Dispersion 2-1

In a constitution of a dispersion cell, in which the outlet 17 of the dispersion cell shown in FIG. 2 was connected to the inlet 16 of another dispersion cell shown in FIG. 2, and the second outlet 17 of the dispersion cell shown in FIG. 2 was further connected to the inlet 6 of the cell shown in FIG. 1, tricresyl phosphate at 60° C. was introduced from the inlet 16 of the preceding dispersion cell, a powder material mixture of coupler-2 was introduced from the preceding inlet 19, and the aqueous medium 2-1 heated to 60° C. was introduced from the second inlet 19 of the dispersion cell, and they were passed for once, and cooled. The pressure was 210 MPa (2100 bar).

Comparison Dispersion 2-2

An aqueous medium 2-2 was prepared by dissolving 100 g of gelatin, 5 g of a dispersant (AEROSOL OT: trade name), and 944 g of water at 40° C. 39 g of coupler-3, 26 g of coupler-4, 30 ml of tricresyl phosphate, and 100 ml of ethyl acetate were mixed, and dissolved at 60° C., to form a composition 2-2. The aqueous medium 2-2 and the composition 2-2 were mixed, stirred by a dissolver, and finely divided into particulates by a dissolver, and ethyl acetate was removed under a reduced pressure.

Invention Dispersion 2-2

In the constitution of a dispersion cell, in which the outlet 17 of the dispersion cell shown in FIG. 2 was connected to the inlet 16 of another dispersion cell shown in FIG. 2, and the inlet 6 of the dispersion cell shown in FIG. 1 was further connected to the second outlet 17 of the dispersion cell shown in FIG. 2, tricresyl phosphate at 60° C. was introduced from the inlet 16 of the preceding dispersion cell, a powder material mixture of coupler-3 and coupler-4 was introduced from the preceding inlet 19, and the aqueous medium 2-2 heated to 60° C. was introduced from the second inlet 6 of the dispersion cell, and they were passed for once, and cooled. The pressure was 210 MPa (2100 bar).

The melting point of the mixture of the couplers 3 and 4 is lower by 3° C. than the mass weighted mean of the melting point of respective couplers at the mixing ratio of this working example.

The each introduction amount was controlled such that all of the above dispersions had an identical composition.

The results are shown in Table 1.

Example 3

(Preparation of Comparison Dispersions 3-1 to 3-3, and Invention Dispersions 3-1 to 3-3)

Comparison Dispersion 3-1

An aqueous medium 3-1 was prepared by dissolving 4 g of sodium octylphenylethoxymethanesulfonate, and 916 g of water at 40° C. 80 g of dye-1 was mixed, and the resulted mixture was dispersed for 3.5 hours by using ULTRAVISCOMILL (trade name) manufactured by AIMEX Co., Ltd.

Comparison Dispersion 3-2

The procedure was the same as for the preparation of Comparison Dispersion 3-1, except that dye-2 was used instead of dye-1.

Invention Dispersion 3-1

In the constitution of the dispersion cell shown in FIG. 2, the aqueous medium 3-1 was introduced from the inlet 16, and the powder material dye-1 was introduced from the inlet 19, passed for once, and cooled. The pressure was 210 MPa (2100 bar), and the back pressure was 10 MPa (100 bar).

Invention Dispersion 3-2

The procedure was the same as for the preparation of Invention Dispersion 3-1, except that dye-2 was used instead of dye-1.

Invention Dispersion 3-3

The procedure was the same as for the preparation of Invention Dispersion 3-1, except that dye-3 was used instead of dye-1.

The results are shown in Table 2. As shown in the table, fine dispersions were obtained in a short time of about 3 to 10 min, according to the present invention.

TABLE 2

| Sample | Average particle size (μm) |
|---|---|
| Comparison Dispersion 3-1 | 0.29 |
| Invention Dispersion 3-1 | 0.12 |
| Comparison Dispersion 3-2 | 0.21 |
| Invention Dispersion 3-2 | 0.09 |
| Invention Dispersion 3-3 | 0.11 |

TABLE 2-continued

| Sample | Average particle size (μm) |
|---|---|

Coupler 1

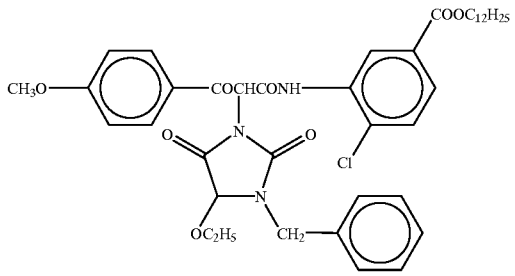

Coupler 2

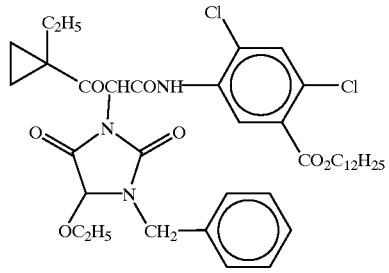

Coupler 3, 4

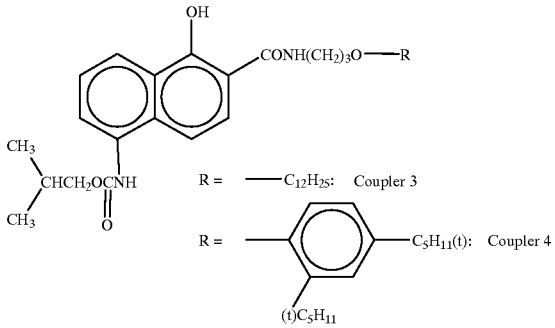

Dye 1

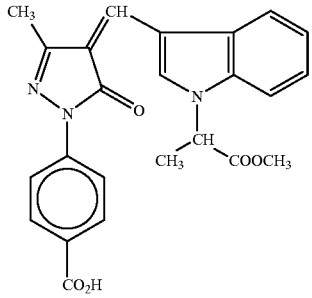

TABLE 2-continued

| Sample | Average particle size (μm) |
|---|---|

Dye 2, 3

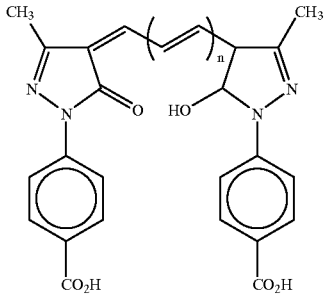

n = 1: Dye 2 n = 2: Dye 3

Example 4

(Preparation of Sample 401)

Layers having the below-shown compositions were formed on a cellulose triacetate film support, having a thickness of 127 μm, that had been provided an undercoat, to prepare a multi-layer color light-sensitive material, which was named Sample 401. Each figure represents the amount to be added per square meter of the light-sensitive material. In the followings, it should be noted that the effect/function of a specific compound added is not limited to the use as described.

| | | |
|---|---|---|
| First Layer: Halation-prevention layer | | |
| Solid Dispersion of D-7 in terms of D-7 | | 0.28 g |
| Gelatin | | 2.20 g |
| Ultraviolet ray absorbent U-1 | | 0.27 g |
| Ultraviolet ray absorbent U-3 | | 0.08 g |
| Ultraviolet ray absorbent U-4 | | 0.08 g |
| High-boiling organic solvent Oil-1 | | 0.29 g |
| Coupler C-9 | | 0.12 mg |
| Second Layer: Intermediate layer | | |
| Gelatin | | 0.38 g |
| Compound Cpd-K | | 5.0 mg |
| Ultraviolet ray absorbent U-2 | | 3.0 mg |
| High-boiling organic solvent Oil-3 | | 0.06 g |
| Dye D-4 | | 10.0 mg |
| Third Layer: Intermediate layer: | | |
| yellow colloidal silver | silver | 0.007 g |
| Gelatin | | 0.40 g |
| Fourth Layer: First red-sensitive emulsion layer | | |
| Emulsion A | silver | 0.55 g |
| Emulsion B | silver | 0.23 g |
| Silver iodobromide emulsion of fine grains, whose surfaces were fogged (av. grain diameter: 0.11 μm) | | 0.07 g |
| Gelatin | | 1.11 g |
| Coupler C-1 | | 0.04 g |
| Coupler C-2 | | 0.09 g |
| Compound Cpd-A | | 1.0 mg |
| Compound Cpd-E | | 0.14 g |
| Compound Cpd-K | | 2.0 mg |
| Compound Cpd-H | | 4.4 mg |
| High-boiling organic solvent Oil-2 | | 0.09 g |
| Fifth Layer: Second red-sensitive emulsion layer | | |
| Emulsion C | silver | 0.14 g |
| Emulsion D | silver | 0.28 g |

-continued

| | | |
|---|---|---|
| Gelatin | | 0.65 g |
| Coupler C-1 | | 0.05 g |
| Coupler C-2 | | 0.11 g |
| Compound Cpd-E | | 0.10 g |
| High-boiling organic solvent Oil-2 | | 0.09 g |
| Sixth Layer: Third red-sensitive emulsion layer | | |
| Emulsion E | silver | 0.50 g |
| Gelatin | | 1.56 g |
| Coupler C-3 | | 0.63 g |
| Compound Cpd-E | | 0.11 g |
| Additive P-1 | | 0.16 g |
| High-boiling organic solvent Oil-2 | | 0.04 g |
| Seventh Layer: Intermediate layer | | |
| Gelatin | | 0.50 g |
| Compound Cpd-D | | 0.04 g |
| High-boiling organic solvent Oil-3 | | 0.08 g |
| Invention Dispersion 3-2 in terms of dye 2 | | 0.07 g |
| Eighth Layer: Intermediate layer | | |
| Yellow colloidal silver | silver | 0.01 g |
| Gelatin | | 1.56 g |
| Compound Cpd-A | | 0.12 g |
| Compound Cpd-I | | 0.04 mg |
| Compound Cpd-J | | 0.07 g |
| High-boiling organic solvent Oil-3 | | 0.15 g |
| Ninth Layer: First green-sensitive emulsion layer | | |
| Emulsion F | silver | 0.42 g |
| Emulsion G | silver | 0.38 g |
| Emulsion H | silver | 0.32 g |
| Silver bromide emulsion of core/shell-type fine grains, whose surfaces were fogged (av. grain diameter: 0.11 μm) | silver | 0.08 g |
| Gelatin | | 1.53 g |
| Coupler C-7 | | 0.07 g |
| Coupler C-8 | | 0.17 g |
| Compound Cpd-B | | 0.30 mg |
| Compound Cpd-C | | 2.00 mg |
| Compound Cpd-K | | 3.0 mg |
| Polymer latex P-2 | | 0.02 g |
| High-boiling organic solvent Oil-2 | | 0.10 g |
| Tenth Layer: Second green sensitive emulsion layer | | |
| Emulsion I | silver | 0.16 g |
| Emulsion J | silver | 0.34 g |
| Gelatin | | 0.75 g |
| Coupler C-4 | | 0.20 g |
| Compound Cpd-B | | 0.03 g |
| Polymer latex P-2 | | 0.01 g |
| High-boiling organic solvent Oil-2 | | 0.01 g |
| Eleventh Layer: Third green-sensitive emulsion layer | | |
| Emulsion K | silver | 0.44 g |
| Gelatin | | 0.91 g |
| Coupler C-4 | | 0.34 g |
| Compound Cpd-B | | 0.06 g |
| Polymer latex P-2 | | 0.01 g |
| High-boiling organic solvent Oil-2 | | 0.02 g |
| Twelfth Layer: Yellow filter layer | | |
| Invention Dispersion 3-1 in terms of dye 1 | | 0.24 g |
| Yellow colloidal silver | | 0.02 g |
| Gelatin | | 0.73 g |
| Compound Cpd-G | | 0.02 g |
| Compound Cpd-J | | 0.04 g |
| High-boiling organic solvent Oil-3 | | 0.08 g |
| Polymer M-1 | | 0.23 g |
| Thirteenth Layer: First blue-sensitive emulsion layer | | |
| Emulsion L | silver | 0.35 g |
| Gelatin | | 0.55 g |
| Coupler C-5 | | 0.20 g |
| Coupler C-6 | | 4.00 g |
| Coupler C-10 | | 0.02 g |
| Compound Cpd-E | | 0.07 g |
| Compound Cpd-K | | 0.03 mg |

-continued

| | | |
|---|---|---|
| Fourteenth Layer: Second blue-sensitive emulsion layer | | |
| Emulsion M | silver | 0.06 g |
| Emulsion N | silver | 0.10 g |
| Gelatin | | 0.75 g |
| Coupler C-5 | | 0.35 g |
| Coupler C-6 | | 5.00 g |
| Coupler C-10 | | 0.30 g |
| Compound Cpd-E | | 0.04 g |
| Fifteenth Layer: Third blue-sensitive emulsion layer | | |
| Emulsion O | silver | 0.20 g |
| Emulsion P | silver | 0.02 g |
| Gelatin | | 2.40 g |
| Coupler C-6 | | 0.09 g |
| Coupler C-10 | | 0.90 g |
| Compound Cpd-E | | 0.09 g |
| Compound Cpd-M | | 0.05 mg |
| High-boiling organic solvent Oil-2 | | 0.40 g |
| Additive P-2 | | 0.10 g |
| Sixteenth Layer: First protective layer | | |
| Gelatin | | 1.30 g |
| Ultraviolet ray absorber U-1 | | 0.10 g |
| ultraviolet ray absorber U-2 | | 0.03 g |
| Ultraviolet ray absorber U-5 | | 0.20 g |
| Compound Cpd-F | | 0.40 g |
| Compound Cpd-J | | 0.06 g |
| Dye D-1 | | 0.01 g |
| Dye D-2 | | 0.01 g |
| Dye D-3 | | 0.01 g |

-continued

| | | |
|---|---|---|
| Dye D-5 | | 0.01 g |
| High-boiling organic solvent Oil-2 | | 0.37 g |
| Seventeenth Layer: Second protective layer | | |
| Silver iodobromide emulsion of fine grains (average grain diameter 0.06 μm, silver iodide content 1 mol%) | silver | 0.05 g |
| Gelatin | | 1.80 g |
| Compound Cpd-L | | 0.8 mg |
| Polymethyl methacrylate (average grain diameter 1.5 μm) | | 5.00 g |
| Copolymer of methyl methacrylate and methacrylic acid (6:4) (average grain diameter 1.5 μm) | | 0.10 g |
| Silicon oil SO-1 | | 0.030 g |
| Surface active agent W-2 | | 0.030 g |
| P-3 | | 0.14 g |

Further, to all emulsion layers, in addition to the above-described components, additives F-1 to F-11 were added. Further, to each layer, in addition to the above-described components, gelatin hardener H-1 and surface active agents W-1, W-3, W-4, W-5, and W-6 for coating and emulsifying were added.

Further, as antifungal and antibacterial agents, phenol, 1,2-benzisothiazoline-3-one, 2-phenoxyethanol, phenetylalcohol, and p-hydroxybenzoic acid butyl ester were added.

The light-sensitive emulsions used for preparation of Sample 401 were shown in Table 3.

TABLE 3

| Emulsion | Sphere-equivalent diameter (μm) | Deviation coefficient of sphere-equivalent diameter (%) | Average aspect ratio of all grains | Iodide content (mol %) | Sensitizing dye Kind | Sensitizing dye Added amount (× $10^{-4}$ mol/molAg) | Sensitizing dye Kind | Sensitizing dye Added amount (× $10^{-4}$ mol/molAg) | Sensitizing dye Kind | Sensitizing dye Added amount (× $10^{-4}$ mol/molAg) |
|---|---|---|---|---|---|---|---|---|---|---|
| A | 0.20 | 16 | 1.6 | 4.0 | S-1 | 8.1 | | | S-3 | 0.3 |
| B | 0.25 | 15 | 3.0 | 4.0 | S-1 | 8.9 | | | S-3 | 0.3 |
| C | 0.22 | 14 | 2.5 | 4.0 | S-1 | 8.8 | S-2 | 0.2 | S-3 | 0.2 |
| D | 0.35 | 10 | 3.6 | 4.0 | S-1 | 9.8 | S-2 | 0.3 | S-3 | 0.2 |
| E | 0.49 | 16 | 5.0 | 2.0 | S-1 | 6.7 | S-2 | 0.5 | S-3 | 0.2 |
| F | 0.15 | 15 | 1.0 | 3.5 | S-4 | 15.1 | S-5 | 1.5 | | |
| G | 0.23 | 14 | 1.9 | 3.5 | S-4 | 10.4 | S-5 | 2.0 | | |
| H | 0.32 | 11 | 2.4 | 3.5 | S-4 | 7.5 | S-5 | 1.4 | | |
| I | 0.28 | 11 | 4.5 | 3.3 | S-4 | 7.7 | S-5 | 1.4 | | |
| J | 0.40 | 16 | 4.0 | 3.3 | S-4 | 7.2 | S-5 | 1.4 | | |
| K | 0.59 | 20 | 5.9 | 2.8 | S-4 | 6.4 | S-5 | 1.2 | | |
| L | 0.24 | 14 | 3.4 | 4.6 | S-6 | 6.5 | S-7 | 2.5 | | |
| M | 0.30 | 10 | 3.0 | 4.6 | S-6 | 6.2 | S-7 | 2.0 | | |
| N | 0.40 | 9 | 4.5 | 1.6 | S-6 | 5.6 | S-7 | 1.8 | | |
| O | 0.60 | 15 | 5.5 | 1.0 | S-6 | 4 | S-7 | 1.5 | | |
| P | 0.80 | 18 | 25 | 1.0 | S-6 | 3.4 | S-7 | 1.1 | | |

Note 1) Each of emulsions described above was subjected to chemical sensitization using gold, sulfur, and selenium.

Note 2) To each emulsions described above, sensitizing dyes were added prior to chemical sensitization.

Note 3) To each emulsions described above, compounds F-5, F-7, F-8, F-9, F-10, F-11, F-12, F-13, F-14, and F-15 were added appropriately.

Note 4) Emulsions described above contain triple structured tabular grains, and the main plane of those grains was a (100) plane for emulsions A, B, I, J and a (111) plane for the other emulsions.

Note 5) Emulsions A, B, E, F, I, P were emulsions containing grains whose internal sensitivity was higher than its surface sensitivity.

Note 6) Emulsions E, I, P contained grains obtained by making epitaxial growth of silver chloride after chemical sensitization.

Note 7) In grains of emulsions other than emulsions A, E, F, at least 50 dislocation lines per grain were observed by means of a transmission-type electron microscope.

C-1
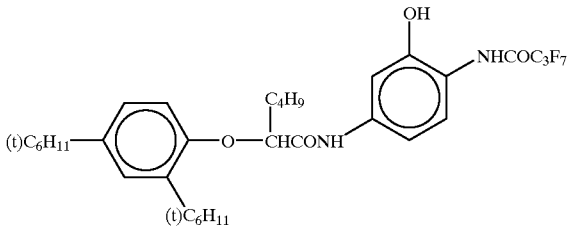
C-2
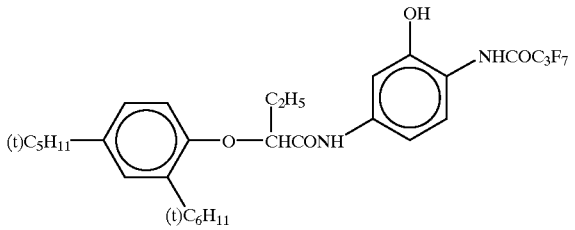
C-3
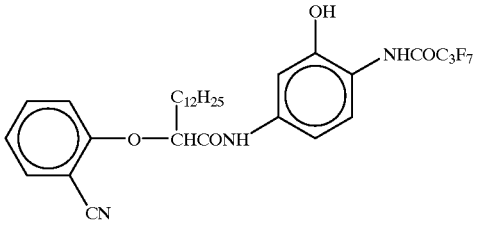
C-4
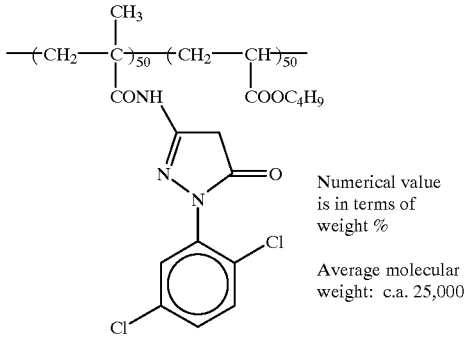
Numerical value is in terms of weight %
Average molecular weight: c.a. 25,000
C-5
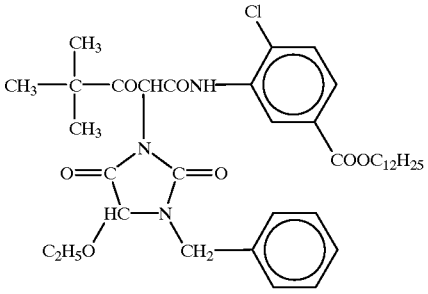
C-6
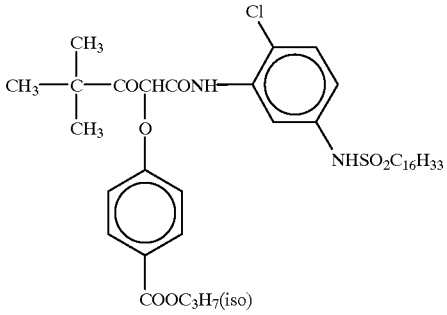
C-7
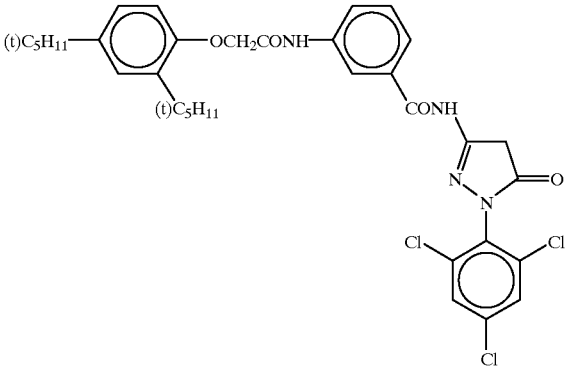
C-8
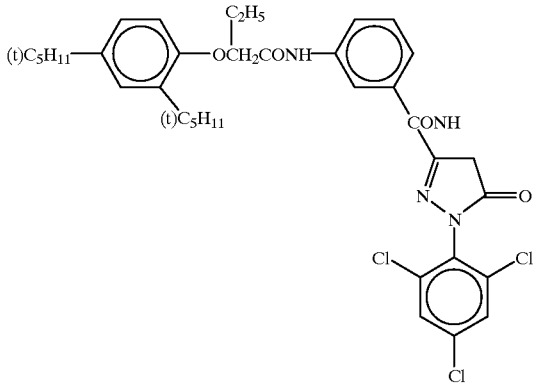

-continued
C-9
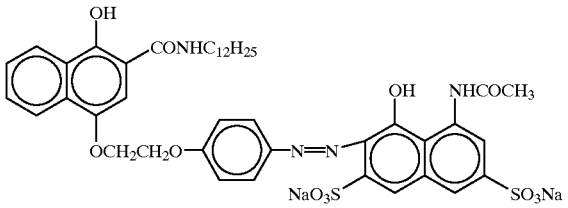
C-10
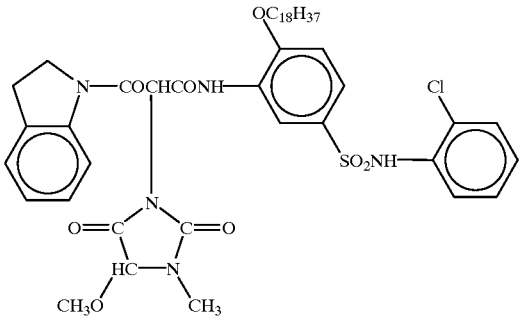
Oil-1
Dimethyl phthalate
Oil-2
Tricresyl phosphate
Oil-3
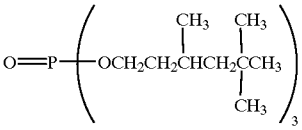
Cpd-A
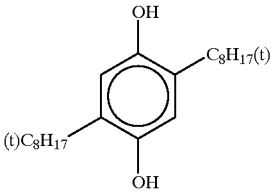
Cpd-B
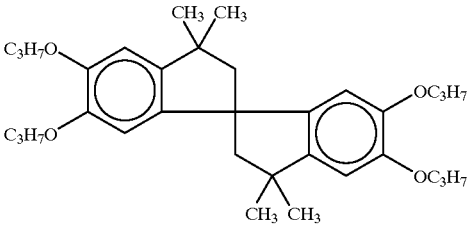
Cpd-C
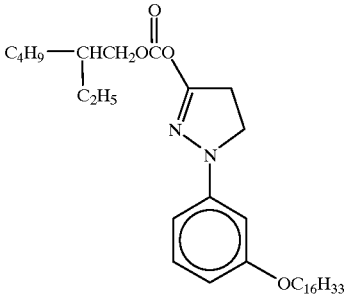
Cpd-D
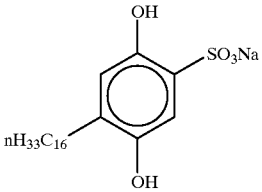
Cpd-E
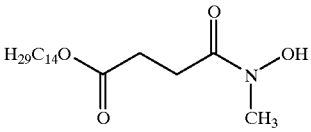
Cpd-F
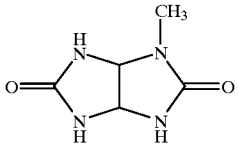
Cpd-G
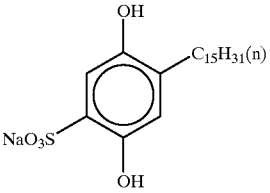
Cpd-H
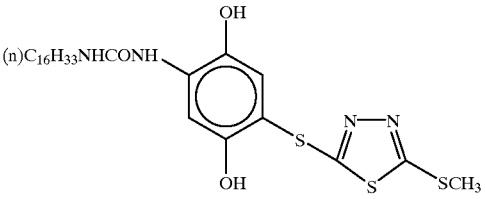
Cpd-I
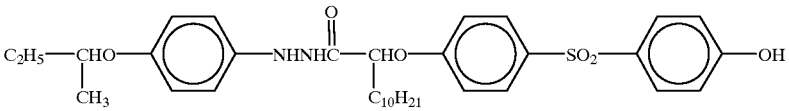

-continued
Cpd-J
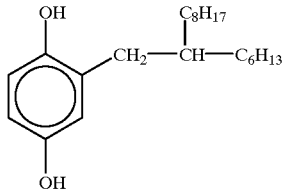
Cpd-K
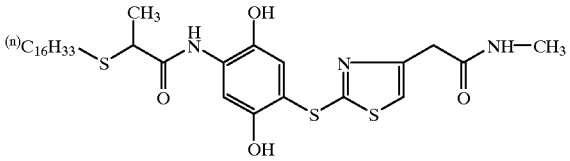
Cpd-L
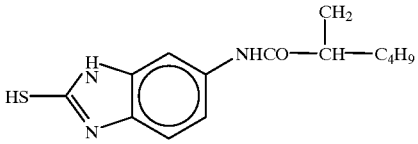
Cpd-M
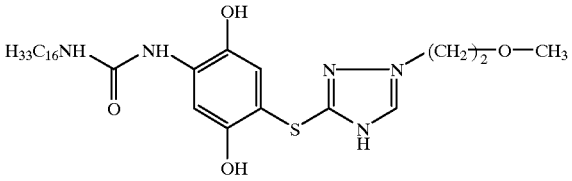
U-1
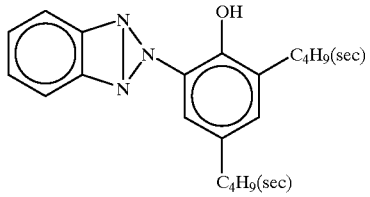
U-2
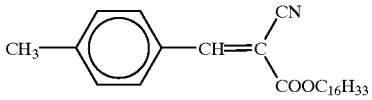
U-3
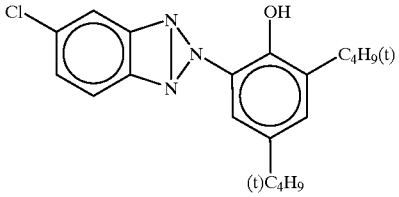
U-4
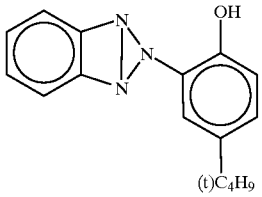
U-5
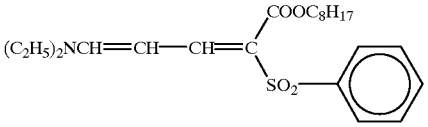
S-1
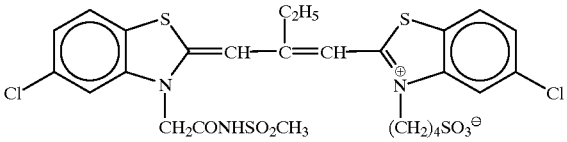
S-2
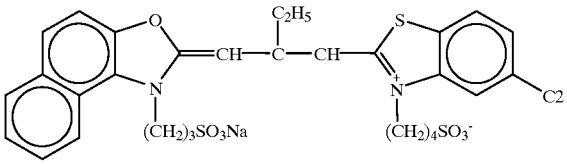
S-3
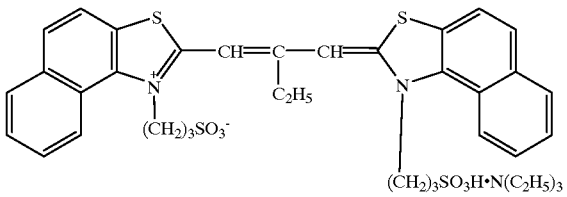
S-4
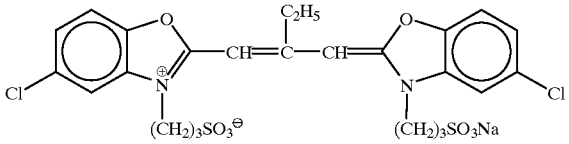
S-5
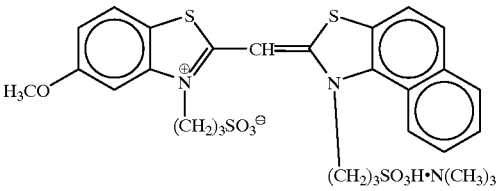

-continued
S-6
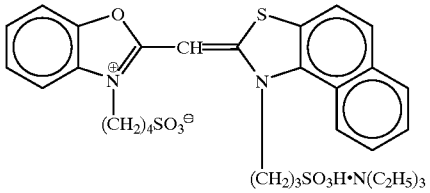
S-7
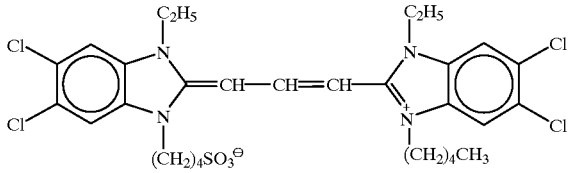
D-1
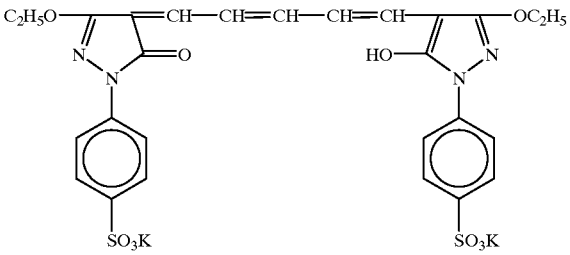
D-2
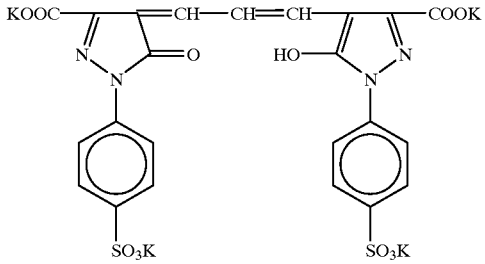
D-3
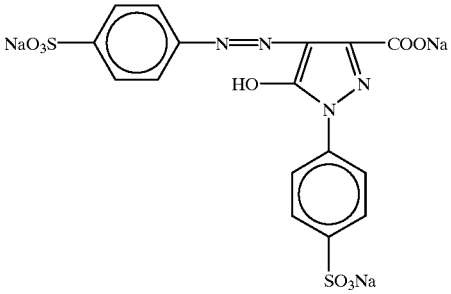
D-4
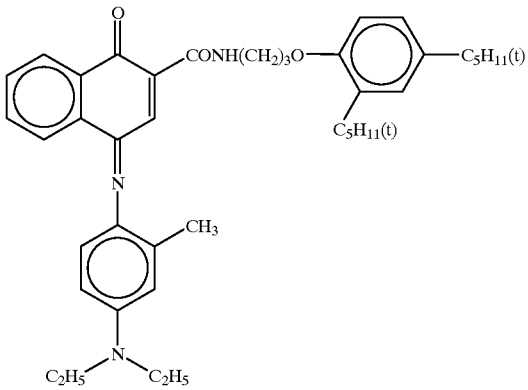
D-5
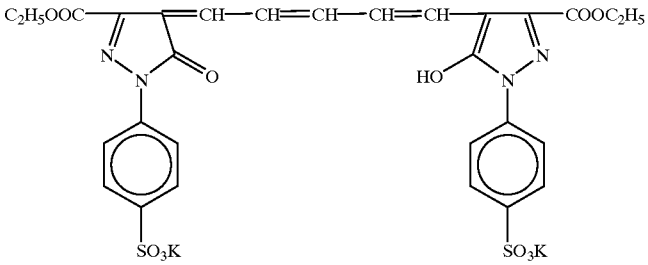
D-7
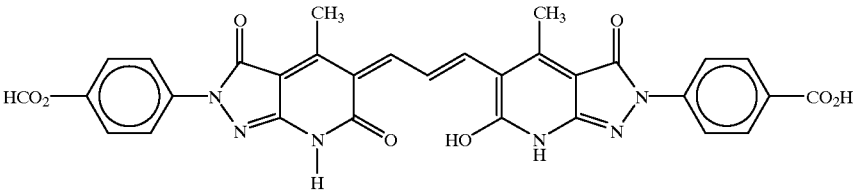
H-1
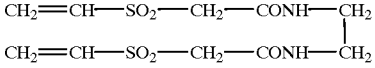
W-1
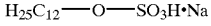
W-2
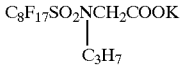
W-3
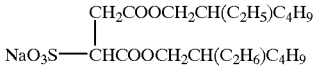

-continued
W-4
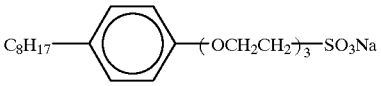
W-5
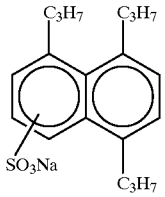
W-6
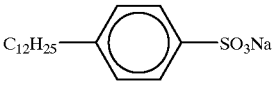
P-1
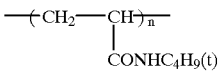
n ≒ 1,000
P-4
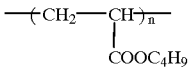
n ≒ 1,000
SO-1
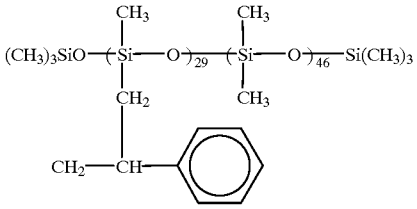
F-1
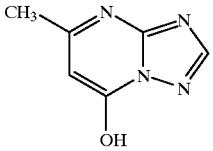
F-2
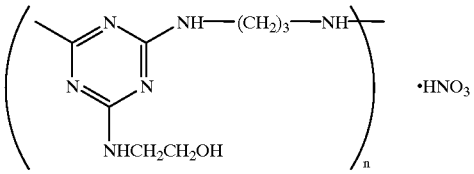
($n$ = 3~4)
F-3
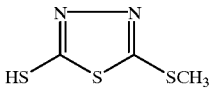
F-4
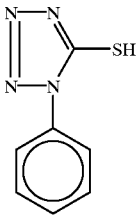
F-5
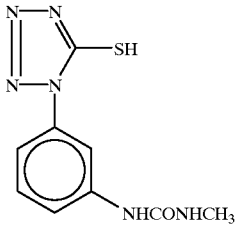
F-6
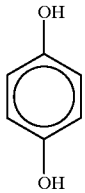
F-7
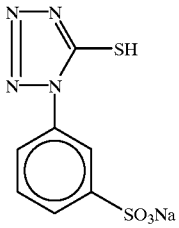
F-8
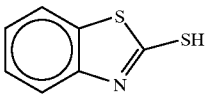

-continued

F-9

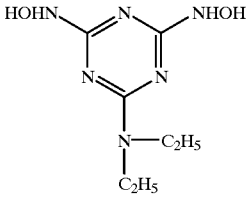

F-10

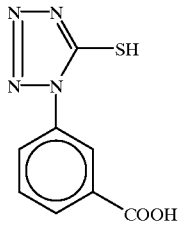

F-11

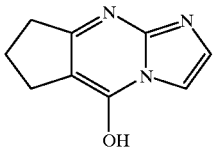

F-12

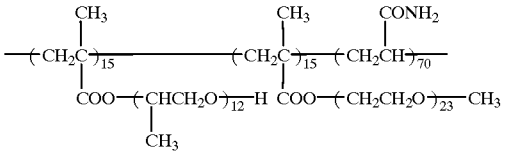

F-13

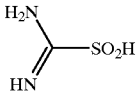

F-14

$K_2IrCl_6$

F-15

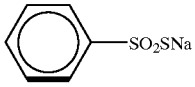

D'-7

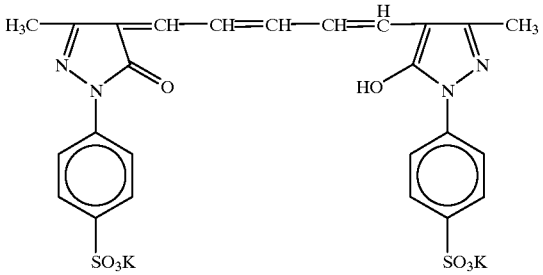

P-2

Copolymer in 95:5 of polybutyl acrylate/acrylic acid

P-3

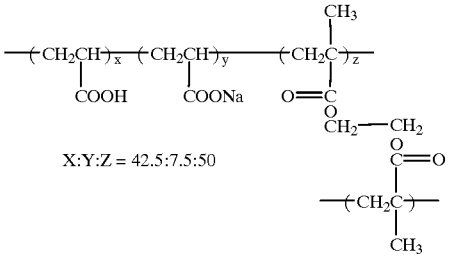

X:Y:Z = 42.5:7.5:50

M-1

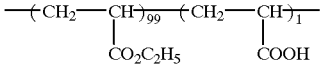

B-1

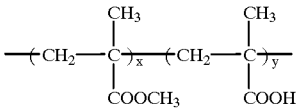

*x/y* = 90/10

B-2

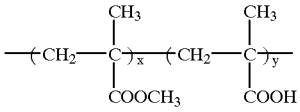

*x/y* = 60/40

The thus-obtained Sample 401 was exposed imagewise. The exposed sample was subjected to a color reversal processing in accordance with the processing steps described below. The processing was practiced by a system in which a sample is conveyed while being hanged on a hanger.

(Processing)

| Processing step | Time | Temperature | Tank Volume | Replenisher |
|---|---|---|---|---|
| 1st development | 6 min | 38° C. | 12 liters | 2,200 ml/m$^2$ |
| 1st Water-washing | 2 min | 38° C. | 4 liters | 7,500 ml/m$^2$ |
| Reversal | 2 min | 38° C. | 4 liters | 1,100 ml/m$^2$ |
| Color development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 2 liters | 220 ml/m$^2$ |
| Fixing | 4 min | 38° C. | 8 liters | 1,100 ml/m$^2$ |
| 2nd Water-washing | 4 min | 38° C. | 8 liters | 7,500 ml/m$^2$ |
| Final rinse | 1 min | 25° C. | 2 liters | 1,100 ml/m$^2$ |

Compositions of each processing solutions used were as follows:

| [First developer] | Tank solution | Replenisher |
|---|---|---|
| Pentasodium nitrilo-N,N,N-trimethylene-phosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |

(pH was adjusted by using sulfuric acid or potassium hydroxide.)

| [Reversal solution] | Tank solution | Replenisher |
|---|---|---|
| Pentasodium nitrilo-N,N,N-trimethylene-phosphonate | 3.0 g | Same to Tank solution |
| Stannous chloride dihydrate | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |

(pH was adjusted by using acetic acid or sodium hydroxide.)

| [Color developer] | Tank solution | Replenisher |
|---|---|---|
| Pentasodium nitrilo-N,N,N-trimethylene-phosphonate | 2.0 g | 2.0 g |
| Sodium sulfite | 7.0 g | 7.0 g |

-continued

| [Color developer] | Tank solution | Replenisher |
|---|---|---|
| Trisodium phosphate 12-hydrate | 36 g | 36 g |
| Potassium bromide | 1.0 g | — |
| Potassium iodide | 90 mg | |
| Sodium hydroxide | 3.0 g | 3.0 g |
| Cytrazinic acid | 1.5 g | 1.5 g |
| N-Ethyl-N-(β-methane-sulfonamidoethyl)-3-methyl-4-aminoaniline-3/2 sulfate-monohydrate | 11 g | 11 g |
| 3,6-Dithiaoctane-1,8-diol | 1.0 g | 1.0 g |
| Water to make | 1,000 ml | 1,000 ml |
| pH | 11.80 | 11.80 |

(pH was adjusted by using acetic acid or potassium hydroxide.)

| [Pre-bleaching solution] | Tank solution | Replenisher |
|---|---|---|
| Disodium ethylenediamine-tetraacetate dihydrate | 8.0 g | 8.0 g |
| Sodium sulfite | 6.0 g | 8.0 g |
| 1-Thioglycerol | 0.4 g | 0.4 g |
| Formaldehyde-sodium bisulfite adduct | 30 g | 35 g |
| Water to make | 1,000 ml | 1,000 ml |
| pH | 6.30 | 6.10 |

(pH was adjusted by using acetic acid or sodium hydroxide.)

| [Bleaching solution] | Tank solution | Replenisher |
|---|---|---|
| Disodium ethylenediamine-tetraacetate dihydrate | 2.0 g | 4.0 g |
| Iron (III) ammonium ethylenediaminetetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

(pH was adjusted by using nitric acid or sodium hydroxide.)

| [Fixing solution] | Tank solution | Replenisher |
|---|---|---|
| Ammonium thiosultate | 80 g | Same to tank solution |
| Sodium sulfite | 5.0 g | Same to tank solution |
| Sodium bisulfite | 5.0 g | Same to tank solution |
| Water to make | 1,000 ml | 1,000 ml |
| pH | 6.60 | |

(pH was adjusted by using acetic acid or aqueous ammonia.)

| [Stabilizing solution] | Tank solution | Replenisher |
|---|---|---|
| 1,2-benzoisothiazoline-3-one | 0.02 g | 0.03 g |
| Polyoxyethylene-p-monononyl phenyl ether (av. polymerization degree: 10) | 0.3 g | 0.3 g |
| Polymaleic acid (av. molecular weight: 2000) | 0.1 g | 0.15 g |
| Water to make | 1,000 ml | 1,000 ml |
| pH | 7.0 | 7.0 |

It was observed that the sample according to the present invention was excellent in such properties as sensitivity, gradation, color saturation, sharpness, color balance at the time of push-processing, silver removal characteristics, and pressure-induced sensitization/desensitization. Further, neither defect nor unevenness were found in the sample.

Example 5

(Preparation of Sample 501)

1) Support

The support that was used in this example was prepared as follows:

100 weight parts of polyethylene-2,6-naphthalate polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and stretched 3.3 times in the lengthwise direction at 140° C., and then 3.3 times in the width direction at 130° C.; and further they were thermally fixed for 6 seconds at 250° C., thereby a PEN film having a thickness of 90 μm was obtained. To the PEN film, appropriate amounts of a blue dye, a magenta dye, and a yellow dye (I-1, I-4, I-6, I-24, I-26, I-27, and II-5, as described in Kokai Giho: Kogi No. 94-6023) were added. Further, this film was wound around a stainless steel core (spool) having a diameter of 20 cm, and thermal history was imparted thereto at 110° C. for 48 hours, to obtain a support having suppressed core-set-curl.

2) Coating of an Undercoat Layer

After both surfaces of the above support were subjected to corona discharge, UV discharge, and glow discharge treatments, each side of the support was coated with an undercoat solution having a composition of 0.1 g/m$^2$ of gelatin, 0.01 g/m$^2$ of sodium a-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product (10 cc/m$^2$, a bar coater was used). The undercoat layer was provided on the side that was heated at a higher temperature at the time of stretching. Drying was carried out at 115° C. for 6 minutes (the roller and the transportation apparatus in the drying zone all were set at 115° C.).

3) Coating of a Backing Layer

An antistatic layer, a magnetic recording layer, and a slipping layer, each having the compositions mentioned below, were coated on one side of the above support coated with the undercoat layer, as a backing layer.

3-1) Coating of an Antistatic Layer 0.2 g/m$^2$ of a dispersion of fine grain powder of a composite of stannic oxide-antimony oxide having an average grain diameter of 0.005 μm, and the specific resistance of 5 Ω·cm (secondary aggregation grain diameter of about 0.08 μm) was coated with 0.05 g/m$^2$ of gelatin, 0.02 g/m$^2$ of $(CH_2{=}CHSO_2CH_2CH_2NHCO)_2CH_2$, 0.005 g/m$^2$ of poly (polymerization degree: 10)oxyethylene-p-nonylphenol, and resorsine.

3-2) Coating of a Magnetic Recording Layer

3-Poly(polymerization degree: 15)oxyethylene-propyloxytrimethoxysilan (15 weight %)-coated Co-γ-iron oxide (specific surface area, 43 m$^2$/g; major axis, 0.14 μm; minor axis, 0.03 μm; saturation magnetization, 89 emu/g, $Fe^{+3}/Fe^{+2}$=6/94; the surface was treated with 2 weight % respectively, based on iron oxide, of aluminum oxide and silicon oxide) (0.06 g/m$^2$), diacetylcellulose (dispersion of the iron oxide was carried out by an open kneader and a sand mill) (1.2 g/m$^2$), and $C_2H_5C(CH_2OCONH{-}C_6H_3(CH_3)NCO)_3$ (0.3 g/m$^2$), as a hardener, were coated using acetone, methylethylketone, and cyclohexanone, as solvents, by means of a bar coater, to obtain a magnetic recording layer having a thickness of 1.2 μm. Silica grains (0.3 μm), as a matte agent, and 3-poly(polymerization degree: 15)oxyethylene-propyloxytrimethoxysilan (15 weight %)-coated aluminum oxide (0.15 μm), as an abrasive, were each added thereto, to give a coverage of 10 mg/m$^2$. Drying was conducted at 115° C. for 6 min (the roller and the transportation apparatus in the drying zone all were set at 115° C.). The increment of the color density of $D^B$ of the magnetic recording layer was about 0.1 when X-light (blue filter) was used. The saturation magnetization moment of the magnetic recording layer was 4.2 emu/g, the coercive force was $7.3\times10^4$ A/m, and the squareness ratio was 65%.

3-3) Preparation of a Slipping Layer

Diacetyl cellulose (25 mg/m$^2$), and a mixture of $C_6H_{13}CH(OH)C^{10}H_{20}COOC_{40}H_{81}$ (Compound a, 6 mg/m$^2$) and $C_{50}H_{101}O(CH_2CH_{20})_{16}H$ (Compound b, 9 mg/m$^2$) were coated. When adding the mixture, the mixture was dissolved in a solution of xylene and propyleneglycol monomethylether (1/1) at 105° C., and this solution was poured into a 10-fold volume of propyleneglycol monomethylether (normal temperature) and finely dispersed. This was further dispersed in acetone, and the obtained dispersion (average grain diameter: 0.01 μm) was added to the coating solution. Silica grains (0.3 μm), as a matte agent, and 3-poly (polymerization degree, 15)oxyethylene-propyloxytrimethoxysilan (15 weight %)-coated aluminum oxide (0.15 μm), as an abrasive, were each added thereto, to give a coverage of 15 mg/m$^2$, respectively. The slipping layer was dried at 115° C. for 6 minutes (the roller and the transportation apparatus in the drying zone all were set at 115° C.). The slipping layer showed excellent performances of the coefficient of dynamic friction: 0.06 (a stainless steel hard ball of 5 mmφ diameter, load: 100 g, speed: 6 cm/min), and of the static friction coefficient: 0.07 (clip method). The sliding property of the slipping layer with the emulsion surface, which will be described below, was also excellent, such that the coefficient of dynamic friction was 0.12.

4) Coating of Light-sensitive Layers

Layers having the below-shown compositions were multi-coated on the support of the opposite side of the backing layer of the support, to prepare a multi-layer color light-sensitive material, Sample 501.

(Compositions of Light-sensitive Layers)

Main materials used in each layer were classified as follows:

ExC: Cyan coupler UV: Ultraviolet ray absorbent

ExM: Magenta coupler HBS: High-boiling organic solvent

ExY: Yellow coupler H': Gelatin hardening agent

ExS: Sensitizing dye

Figures corresponding to each component represent the coating amount in terms of g/m$^2$, and for silver halide, in terms of silver. With respect to sensitizing dyes, the coating amount is shown in mol, per mol of the silver halide in the same layer.

(Sample 501)

First Layer (First Halation-preventing Layer)

| | | |
|---|---|---|
| Black colloidal silver | silver | 0.155 |
| Silver iodobromide emulsion P | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

Second Layer (Second Halation-preventing Layer)

| | | |
|---|---|---|
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid Dispersion ExF-2 | | 0.140 |

Third Layer (Intermediate Layer)

| | |
|---|---|
| Silver iodobromide emulsion O | 0.020 |
| ExC-2 | 0.022 |
| Polyethyl acrylate latex | 0.085 |
| Gelatin | 0.294 |

Fourth Layer (Low-sensitivity Red-sensitive Emulsion Layer)

| | | |
|---|---|---|
| Silver iodobromide emulsion A | silver | 0.323 |
| ExS-1 | | $5.5 \times 10^{-4}$ |
| ExS-2 | | $1.0 \times 10^{-5}$ |
| ExS-3 | | $2.4 \times 10^{-4}$ |
| ExC-1 | added as Invention Dispersion 2-2 | 0.109 |
| ExC-3 | | 0.044 |
| ExC-4 | added as Invention Dispersion 2-2 | 0.067 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |

Fifth Layer (Medium-sensitivity red-sensitive emulsion layer)

| | | |
|---|---|---|
| Silver iodobromide emulsion B | silver | 0.28 |
| Silver iodobromide emulsion C | silver | 0.54 |
| ExS-1 | | $5.0 \times 10^{-4}$ |
| ExS-2 | | $1.0 \times 10^{-5}$ |
| ExS-3 | | $2.0 \times 10^{-4}$ |
| ExC-1 | added as Invention Dispersion 2-2 | 0.15 |
| ExC-2 | | 0.026 |
| ExC-3 | | 0.020 |
| ExC-4 | added as Invention Dispersion 2-2 | 0.09 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |

-continued

Sixth Layer (High-sensitivity red-sensitive emulsion layer)

| | | |
|---|---|---|
| Silver iodobromide emulsion D | silver | 1.47 |
| ExS-1 | | $3.7 \times 10^{-4}$ |
| ExS-2 | | $1 \times 10^{-5}$ |
| ExS-3 | | $1.8 \times 10^{-4}$ |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |

Seventh Layer (Intermediate layer)

| | |
|---|---|
| Cpd-1 | 0.089 |
| Invention Dispersion 3-2 was used in terms of ExF-4 | 0.030 |
| HBS-1 | 0.050 |
| Polyethyl acrylate latex | 0.83 |
| Gelatin | 0.84 |

Eighth Layer (Layer imparting interlayer effect to the red-sensitive layers)

| | | |
|---|---|---|
| Silver iodobromide emulsion E | silver | 0.560 |
| ExS-6 | | $1.7 \times 10^{-4}$ |
| ExS-10 | | $4.6 \times 10^{-4}$ |
| Cpd-4 | | 0.030 |
| ExM-2 | | 0.096 |
| ExM-3 | | 0.028 |
| ExY-1 | | 0.031 |
| HBS-1 | | 0.085 |
| HBS-3 | | 0.003 |
| Gelatin | | 0.58 |

Ninth Layer (Low-sensitivity green-sensitive emulsion layer)

| | | |
|---|---|---|
| Silver iodobromide emulsion F | silver | 0.39 |
| Silver iodobromide emulsion G | silver | 0.28 |
| Silver iodobromide emulsion H | silver | 0.35 |
| ExS-4 | | $2.4 \times 10^{-5}$ |
| ExS-5 | | $1.0 \times 10^{-4}$ |
| ExS-6 | | $3.9 \times 10^{-4}$ |
| ExS-7 | | $7.7 \times 10^{-5}$ |
| ExS-8 | | $3.3 \times 10^{-4}$ |
| ExM-2 | | 0.36 |
| ExM-3 | | 0.045 |
| HBS-1 | | 0.28 |
| HBS-3 | | 0.01 |
| HBS-4 | | 0.27 |
| Gelatin | | 1.39 |

Tenth Layer (Medium-sensitivity green-sensitive emulsion layer)

| | | |
|---|---|---|
| Silver iodobromide emulsion I | silver | 0.45 |
| ExS-4 | | $5.3 \times 10^{-5}$ |
| ExS-7 | | $1.5 \times 10^{-4}$ |
| ExS-8 | | $6.3 \times 10^{-4}$ |
| ExC-6 | | 0.009 |
| ExM-2 | | 0.031 |
| ExM-3 | | 0.029 |
| ExY-1 | | 0.006 |
| ExM-4 | | 0.028 |
| HBS-1 | | 0.064 |
| HBS-3 | | $2.1 \times 10^{-3}$ |
| Gelatin | | 0.44 |

Eleventh Layer (High-sensitivity green-sensitive emulsion layer)

| | | |
|---|---|---|
| Silver iodobromide emulsion I | silver | 0.19 |
| Silver iodobromide emulsion J | silver | 0.80 |
| ExS-4 | | $4.1 \times 10^{-5}$ |
| ExS-7 | | $1.1 \times 10^{-4}$ |
| ExS-8 | | $4.9 \times 10^{-4}$ |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |

-continued

| | | |
|---|---|---|
| ExM-2 | | 0.013 |
| Cpd-3 | | 0.004 |
| Cpd-4 | | 0.007 |
| HBS-1 | | 0.18 |
| Polyethyl acrylate latex | | 0.099 |
| Gelatin | | 1.11 |
| Twelfth Layer (Yellow filter layer) | | |
| Yellow colloidal silver | silver | 0.047 |
| Cpd-1 | | 0.16 |
| Invention Dispersion 3-1 was used in terms of ExF-8 | | 0.15 |
| HBS-1 | | 0.082 |
| Gelatin | | 1.057 |
| Thirteenth Layer (Low-sensitivity blue-sensitive emulsion layer) | | |
| Silver iodobromide emulsion K | silver | 0.18 |
| Silver iodobromide emulsion L | silver | 0.20 |
| Silver iodobromide emulsion M | silver | 0.07 |
| ExS-9 | | $4.4 \times 10^{-4}$ |
| ExS-10 | | $4.0 \times 10^{-4}$ |
| ExC-1 | | 0.041 |
| ExC-8 | | 0.012 |
| ExY-1 | | 0.035 |
| ExY-2 | added as Invention Dispersion 1-5 | 0.71 |
| ExY-3 | added as Invention Dispersion 2-1 | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| Fourteenth Layer (High-sensitivity blue-sensitive emulsion layer) | | |
| Silver iodobromide emulsion N | silver | 0.75 |
| ExS-9 | | $3.6 \times 10^{-4}$ |
| ExC-1 | | 0.013 |
| ExY-2 | added as Invention Dispersion 1-5 | 0.31 |
| ExY-3 | added as Invention Dispersion 2-1 | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |

-continued

| | | |
|---|---|---|
| Fifteenth Layer (First protective layer) | | |
| Silver iodobromide emulsion O | silver | 0.30 |
| UV-1 | | 0.21 |
| UV-2 | | 0.13 |
| UV-3 | | 0.20 |
| UV-4 | | 0.025 |
| F'-18 | | 0.009 |
| HBS-1 | | 0.12 |
| HBS-4 | | $5.0 \times 10^{-2}$ |
| Gelatin | | 2.3 |
| Sixteen Layer (Second protective layer) | | |
| H'-1 | | 0.40 |
| B'-1 (diameter: 1.7 μm) | | $5.0 \times 10^{-2}$ |
| B'-2 (diameter: 1.7 μm) | | 0.15 |
| B'-3 | | 0.05 |
| S'-1 | | 0.20 |
| Gelatin | | 0.75 |

Further, in order to improve storability, processability, pressure resistance, antimold and antibacterial properties, antistatic property, and coating property, compounds of W'-1 to W'-5, B'-4 to B'-6, and F'-1 to F'-18, and salts of iron, lead, gold, platinum, palladium, iridium, rutheniumu, and rhodium were appropriately added in each layer. Also, $8.5\times10^{-3}$ g of calcium per mol of the silver halide in the composition for the coating of the eighth layer, and $7.9\times10^{-3}$ g of calcium per mol of the silver halide in the eleventh layer, were added in the form of an aqueous calcium nitrate solution, thereby the sample was prepared.

The AgI content, the grain size, the surface iodide content (percentage), and so on of the emulsions indicated by the above-described abbreviations, are shown in the following Table 4. The surface iodide content can be determined by XPS as described below. Namely, the samples were cooled to −115° C. in a vacuum of $1\times10^{-5}$ Torr or below, and then MgKα as a probe X ray was irradiated to the cooled samples at X ray source voltage of 8 kV and X ray electric current of 20 mA, and thereafter a measurement was carried out with respect to Ag 3d5/2, Br 3d, and I 3d5/2 electrons. An integral intensity of the measured peak was corrected with a sensitivity factor. The surface iodide content was determined, based on these intensity ratios.

TABLE 4

| Name of emulsion | Average iodide content (mol %) | Deviation coefficient concerning distribution of iodine among grains | Average grain diameter (sphere-equivalent diameter; μm) | Deviation coefficient of sphere-equivalent diameter (%) | Diameter of projected area (circle-equivalent diameter; μm) | Ratio of diameter/thickness | Surface iodide content (MOL %) | Grain shape |
|---|---|---|---|---|---|---|---|---|
| Emulsion A | 3.9 | 20 | 0.37 | 19 | 0.40 | 2.7 | 2.3 | tabular grains |
| Emulsion B | 5.1 | 17 | 0.52 | 21 | 0.67 | 5.2 | 3.5 | tabular grains |
| Emulsion C | 7.0 | 18 | 0.86 | 22 | 1.27 | 5.9 | 5.2 | tabular grains |
| Emulsion D | 4.2 | 17 | 1.00 | 18 | 1.53 | 6.5 | 2.8 | tabular grains |
| Emulsion E | 7.2 | 22 | 0.87 | 22 | 1.27 | 5.7 | 5.3 | tabular grains |
| Emulsion F | 2.6 | 18 | 0.28 | 19 | 0.28 | 1.3 | 1.7 | tabular grains |
| Emulsion G | 4.0 | 17 | 0.43 | 19 | 0.58 | 3.3 | 2.3 | tabular grains |
| Emulsion H | 5.3 | 18 | 0.52 | 17 | 0.79 | 6.5 | 4.7 | tabular grains |
| Emulsion I | 5.5 | 16 | 0.73 | 15 | 1.03 | 5.5 | 3.1 | tabular grains |
| Emulsion J | 7.2 | 19 | 0.93 | 18 | 1.45 | 5.5 | 5.4 | tabular grains |
| Emulsion K | 1.7 | 18 | 0.40 | 16 | 0.52 | 6.0 | 2.1 | tabular grains |
| Emulsion L | 8.7 | 22 | 0.64 | 18 | 0.86 | 6.3 | 5.8 | tabular grains |
| Emulsion M | 7.0 | 20 | 0.51 | 19 | 0.82 | 5.0 | 4.9 | tabular grains |
| Emulsion N | 6.5 | 22 | 1.07 | 24 | 1.52 | 7.3 | 3.2 | tabular grains |
| Emulsion O | 1.0 | — | 0.07 | — | 0.07 | 1.0 | — | uniform structure |
| Emulsion P | 0.9 | — | 0.07 | — | 0.07 | 1.0 | — | uniform structure |

In Table 4, (1) Emulsions L to O were subjected to reduction sensitization using thiourea dioxide and thiosulfonic acid at the time of preparation of grains, according to the example described in JP-A-2-191938.

(2) Emulsions A to O were subjected to gold sensitization, sulfur sensitization and selenium sensitization, in the presence of respective spectral sensitizing dyes as described for each light-sensitive layer and sodium thiocyanate, according to the example described in JP-A-3-237450.

(3) At the preparation of tabular grains, low-molecular-weight gelatin was used, according to the example described in JP-A-1-158426.

(4) In tabular grains, there were observed dislocation lines by a high-pressure electron microscope, as described in JP-A-3-237450.

Preparation of a Dispersion of an Organic Solid Disperse Dye

The following ExF-2 was dispersed by the method described below. That is, 21.7 ml of water, 3 ml of 5% aqueous solution of sodium p-octylphenoxyethoxyethoxyethanesulfonate, and 0.5 g of 5% aqueous solution of p-octylphenoxypolyoxyethylene ether (polymerization degree 10) were charged in a 700 ml pot mill, to which 5.0 g of dye ExF-2 and 500 ml of zirconium oxide beads (1 mm in diameter) were added, and the contents were dispersed for 2 hours. For the dispersion, a BO-type vibrational ball mill manufactured by Chuo Koki Co., Ltd. was used. After the dispersion, the contents were taken out and added to 8 g of an aqueous 12.5% gelatin solution, and then the beads were removed by filtration, to obtain a gelatin dispersion of the dye. The average grain diameter of the dye in the form of fine grains was 0.44 $\mu$m.

The compounds used to form each of the above layers are as shown below.

ExC-1

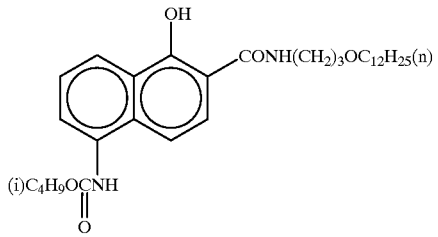

ExC-2

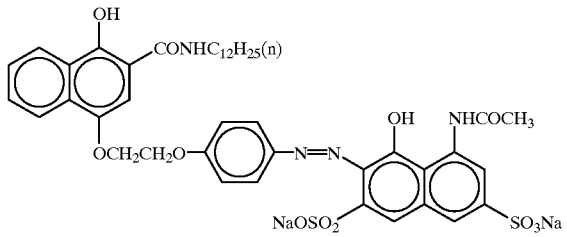

ExC-3

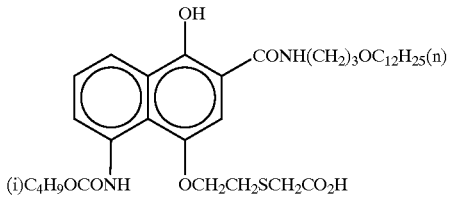

ExC-4

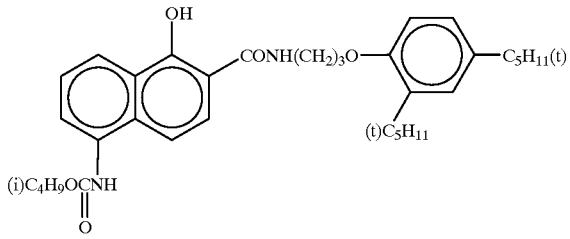

ExC-5

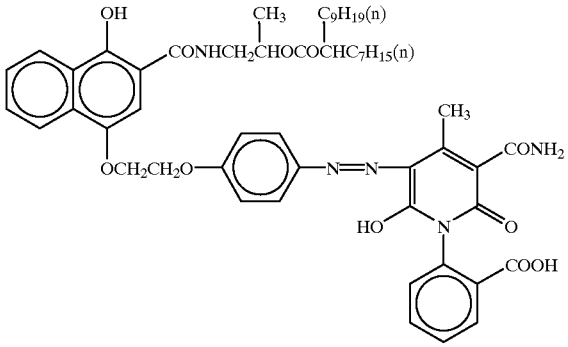

ExC-6

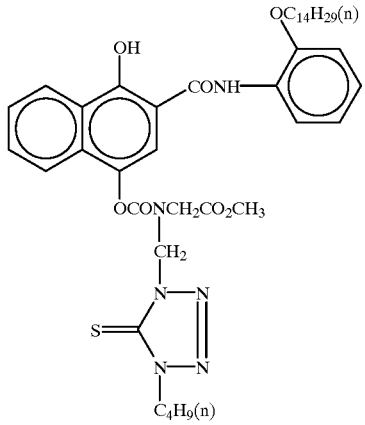

-continued
ExC-7
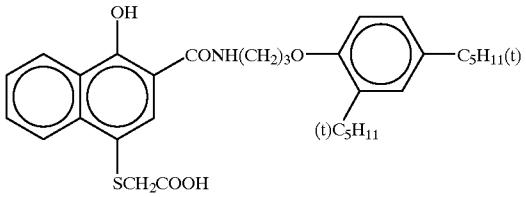
ExC-8
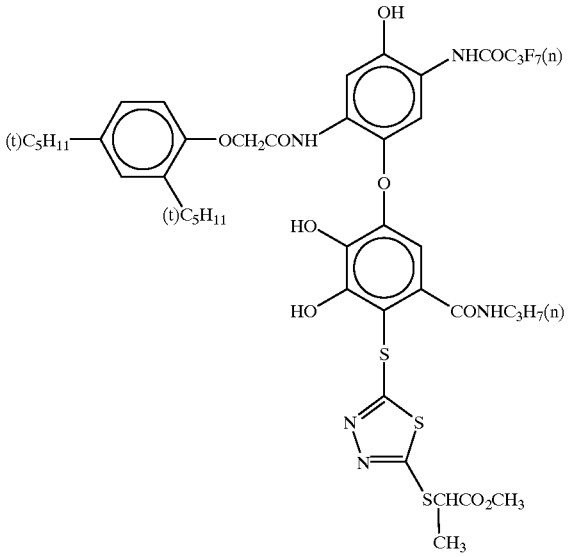
ExM-1
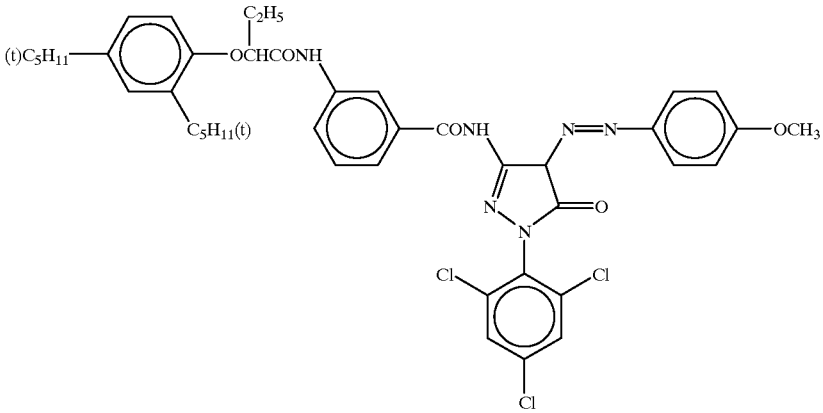
ExM-2
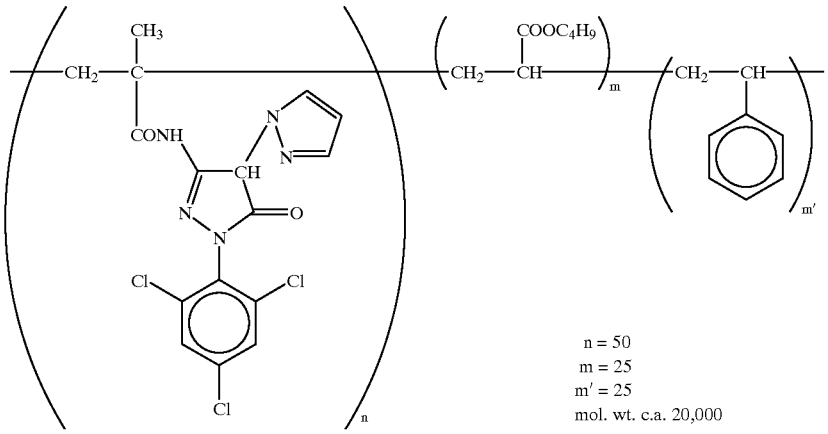

-continued
ExM-3
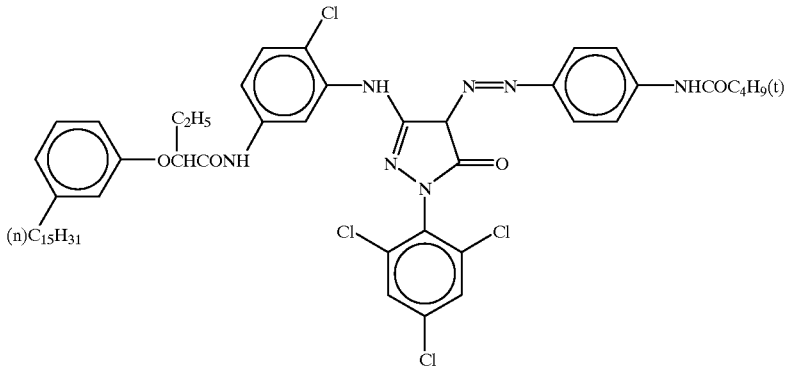
ExM-4
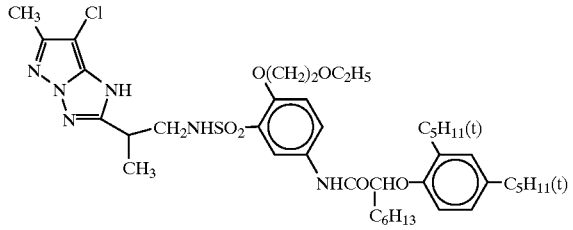
ExM-5
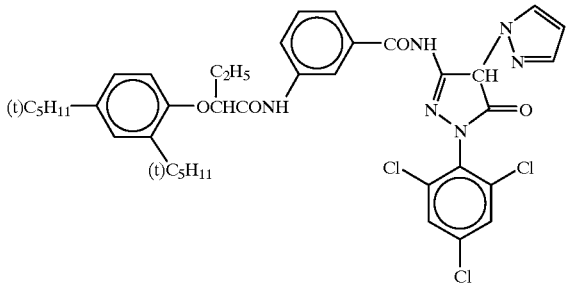
ExY-1
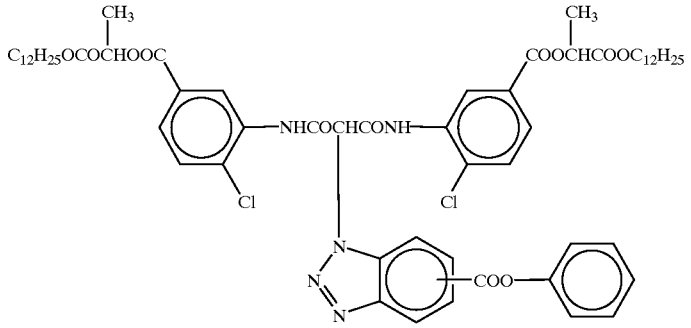
ExY-2
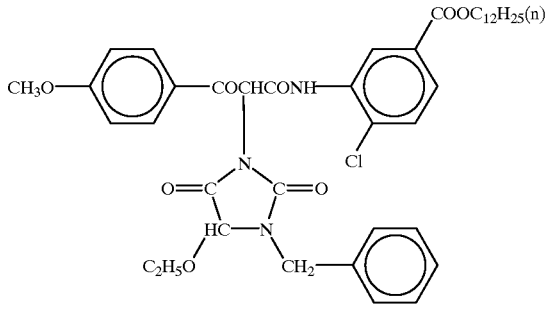
ExY-3
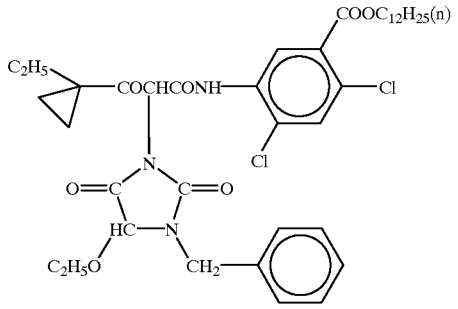

-continued
ExY-4
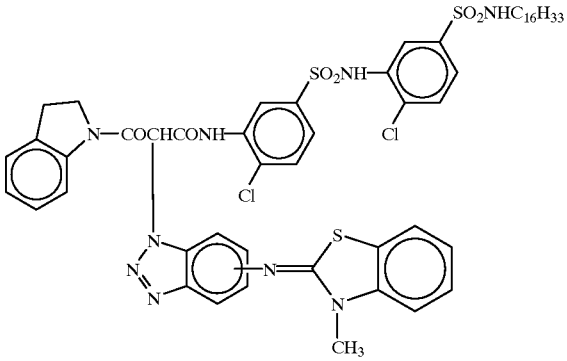
ExY-5
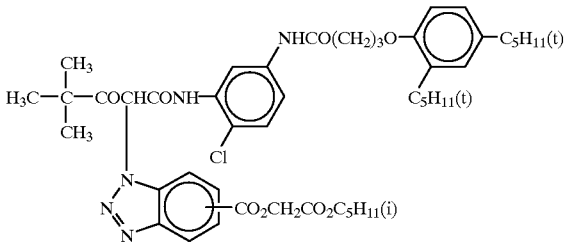
ExY-6
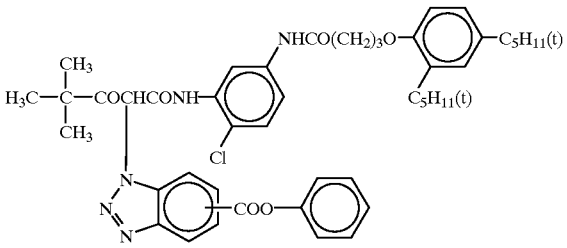
ExF-1
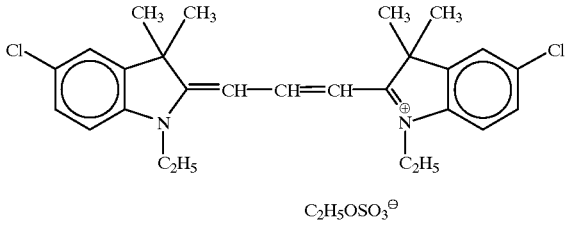
ExF-2
(same as the above-described D-7)
ExF-4
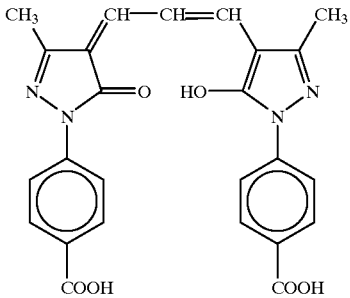
ExF-8
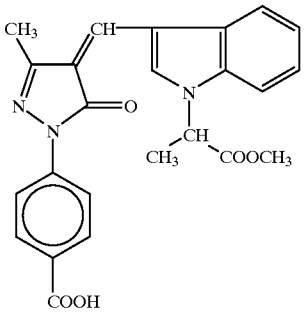
Cpd-1
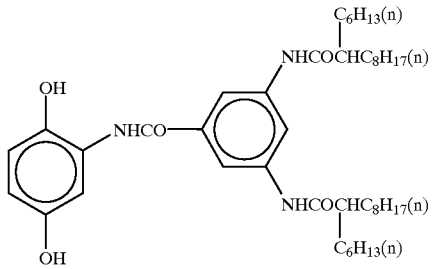
Cpd-2
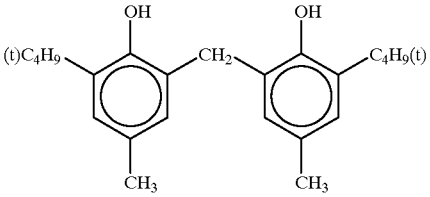
Cpd-3
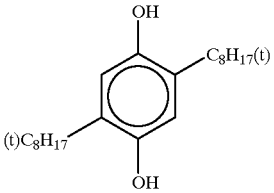

-continued
Cpd-4
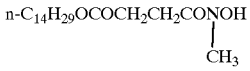
UV-1
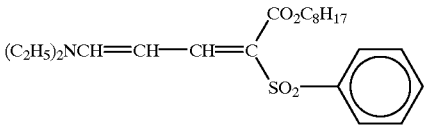
UV-2
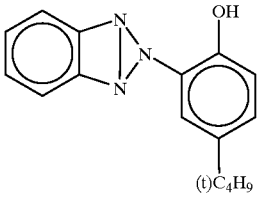
UV-3
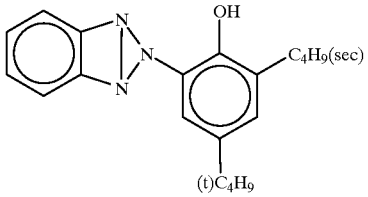
UV-4
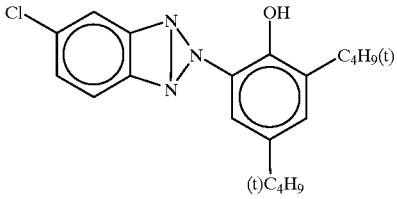
HBS-1
Tricresyl phosphate
HBS-2
Di-n-butyl phthalate
HBS-3
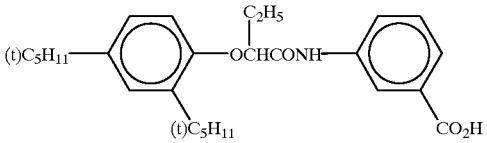
HBS-4
Tri(2-ethylhexyl)phosphate
ExS-1
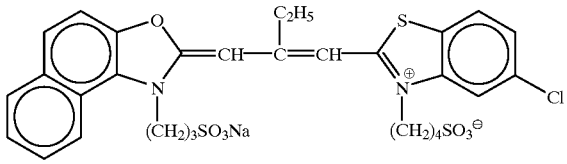
ExS-2
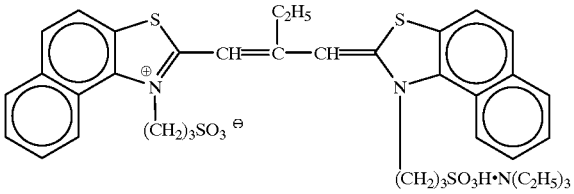
ExS-3
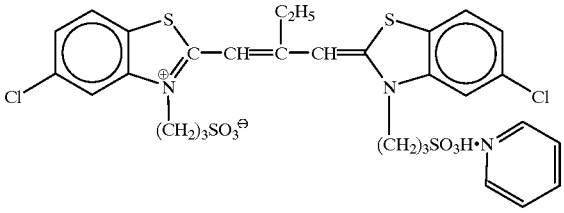
ExS-4
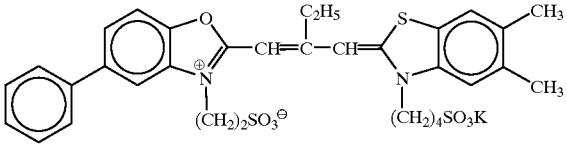
ExS-5
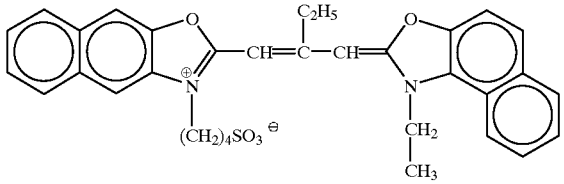

-continued
ExS-6
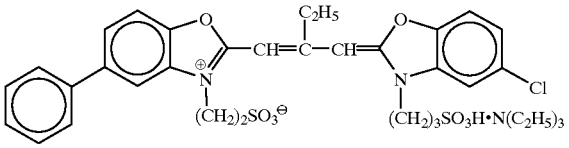
ExS-7
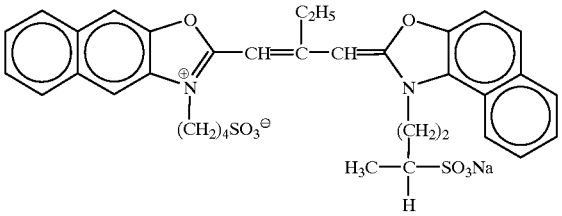
ExS-8
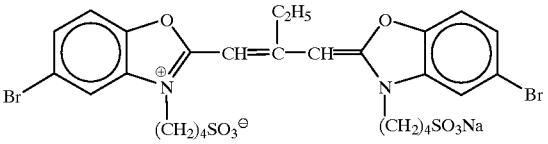
ExS-9
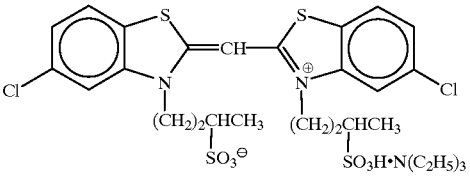
S′-1
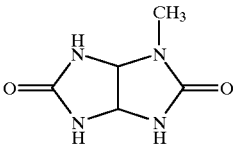
ExS-10
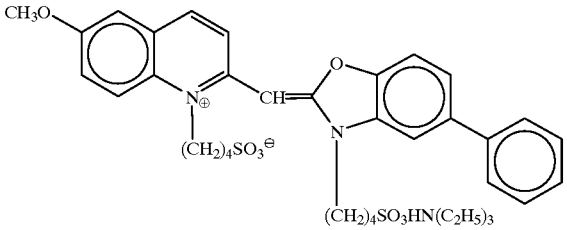
ExS-11
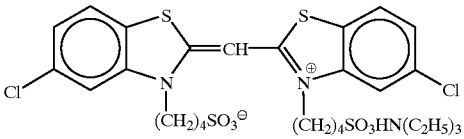
H′-1
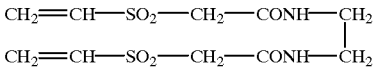
B′-1
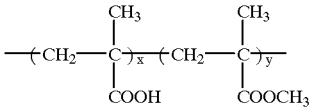
x/y = 10/90 (weight ratio)
average molecular
weight: c.a. 35,000
B′-2
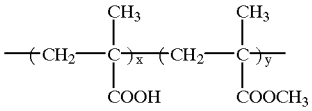
x/y = 40/60 (weight ratio)
average molecular
weight: c.a. 20,000
B′-3
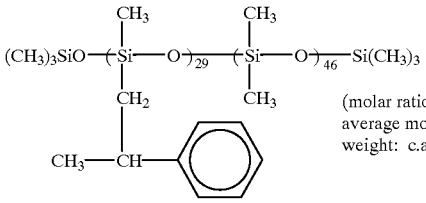
(molar ratio)
average molecular
weight: c.a. 8,000
B′-4
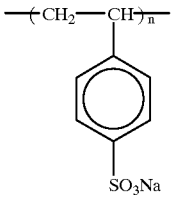
average molecular
weight: c.a. 750,000
B′-5
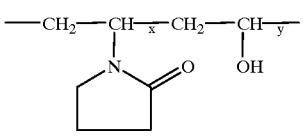
x/y = 70/30 (weight ratio)
average molecular
weight: c.a. 17,000
B′-6
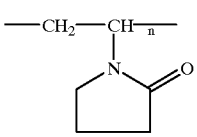
average molecular
weight: c.a. 10,000
W′-1
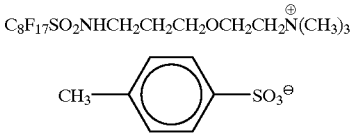
W′-2
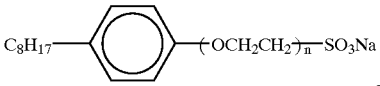
n = 2~4

-continued
W′-3
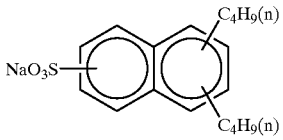
W′-4
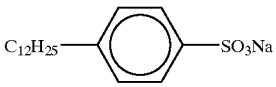
W′-5
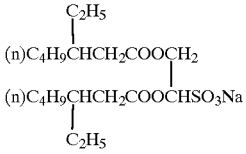
F′-1
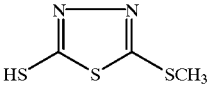
F′-2
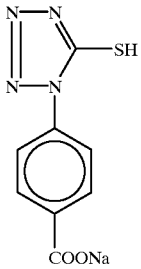
F′-3
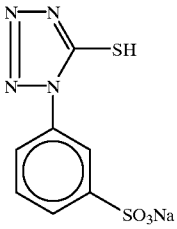
F′-4
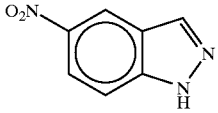
F′-5
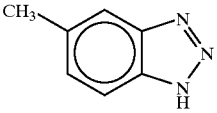
F′-6
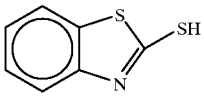
F′-7
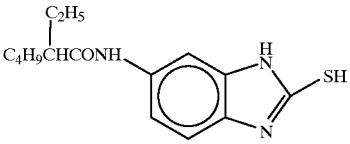
F′-8
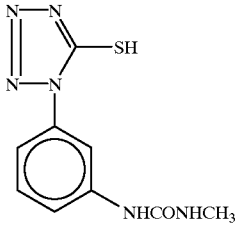
F′-9
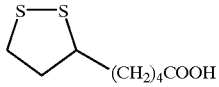
F′-10
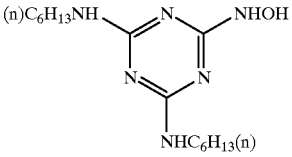
F′-11
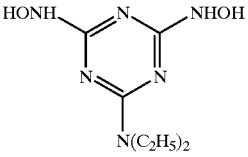
F′-12
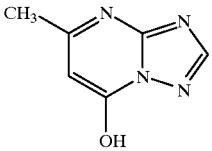
F′-13
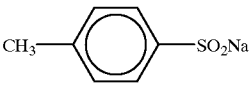

-continued

F′-14

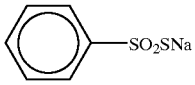

F′-15

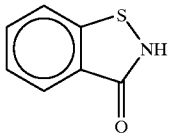

F′-16

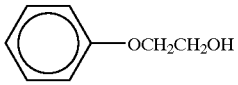

F′-17

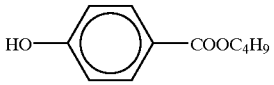

F′-18

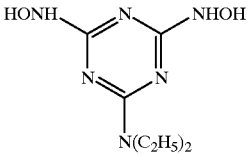

The development processing method of each sample is shown below.

(Processing Method)

| Processing step | Processing time | Processing temperature |
|---|---|---|
| Color developing | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilizing | 30 sec | 38° C. |
| Drying | 4 min 20 sec | 50° C. |

The composition of each processing solution is shown below.

(Color-developer)

| | (g) |
|---|---|
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl) amino]-2-methylaniline sulfate | 4.5 |
| Water to make | 1.0 liter |
| pH | 10.5 |

(pH was adjusted by potassium hydroxide and sulfuric acid.)

(Bleaching Solution and Fixing Solution)

| | (g) |
|---|---|
| Ethylenediaminetetraacetic acid iron (III) sodium trihydrate | 100.0 |
| Disodium ethylenediaminetetraacetate | 10.0 |
| 3-Mercapto-1,2,4,-triazole | 0.03 |

-continued

| | (g) |
|---|---|
| Ammonium bromide | 140.0 |
| Ammonium nitrate | 30.0 |
| Aqueous ammonia (27%) | 6.5 ml |
| Water to make | 1.0 liter |
| pH | 6.0 |

(pH was adjusted by aqueous ammonia and nitric acid.)

(Fixing Solution)

| | (g) |
|---|---|
| Disodium ethylenediaminetetraacetate | 0.5 |
| Ammonium sulfite | 20.0 |
| Aqueous ammonium thiosulfate solution (700 g/liter) | 295.0 ml |
| Acetic acid (90%) | 3.3 |
| Water to make | 1.0 liter |
| pH | 6.7 |

(pH was adjusted by aqueous ammonia and acetic acid.)

(Stabilizing Solution)

| | (g) |
|---|---|
| p-Nonylphenoxypolyglycidol (av. polymerization degree of glycidol: 10) | 0.2 |
| Ethylenediaminetetraacetic acid | 0.05 |
| 1,2,4-Triazole | 1.3 |
| 1,4-Bis(1,2,4-triazole-1-ylmethyl)pyperazine | 0.75 |
| Hydroxyacetic acid | 0.02 |
| Hydroxyethylcellulose (manufactured by Daicell Chemicals Co., Ltd., trade name, HEC SP-2000) | 0.1 |
| 1,2-Benzisothiazoline-3-one | 0.05 |
| Water to make | 1.0 liter |
| pH | 8.5 |

Sample 501 was favorable in view of sensitivity, graininess, sharpness, color saturation, and color reproduction.

Example 6

In Example 1 described in JP-A-9-222694, Invention Dispersion 3-3 was employed in place of the dispersion of dye C. As a result, a desired preferable crossover-cut property was obtained in the resultant sample.

Example 7

(Preparation of Comparison Dispersion 7-1, and Invention Dispersions 7-1 to 7-5)

An aqueous medium 7-1 was prepared by dissolving 715 g of gelatin, 5 g of sodium dodecylbenzenesulfonate, and 855 g of water at 40° C. 110 g of coupler-1 and 115 ml of ethyl acetate were mixed and dissolved at 60° C., to form a composition 7-1. The aqueous medium 7-1 and the composition 7-1 were mixed, and stirred by a dissolver, to obtain a coarse liquid dispersion 7-1.

Comparison Dispersion 7-1

The coarse liquid dispersion 7-1 was finely divided into particulates in a dissolver, and ethyl acetate was removed under reduced pressure.

Invention Dispersion 7-1

In the constitution of a dispersion cell, in which the inlet 6 of the dispersion cell shown in FIG. 1 was connected to the outlet 17 of the dispersion cell shown in FIG. 2, the aqueous medium 7-1 heated to 40° C. was introduced from the inlet 16, and the powder material coupler-1 was introduced from the inlet 19 through a hopper, respectively, passed for once, and cooled. They were passed for once at 300 MPa (3000 bar).

Invention Dispersions 7-2 to 7-5

Aqueous media 7-2 to 7-5 were prepared, by replacing sodium dodecylbenzenesulfonate in the aqueous medium 7-1 with the dispersing agent in the amounts shown in Table 5. By changing the aqueous medium 7-1 in the Invention Dispersion 7-1 to the aqueous media 7-2 to 7-5 respectively, and processing them in the same manner as Invention Dispersion 7-1, Invention Dispersions 7-2 to 7-5 were prepared.

TABLE 5

| | Surface-active agent | |
|---|---|---|
| Aqueous medium 7-2 | sodium dodecylbenzenesulfonate | 2 g |
| Aqueous medium 7-3 | sodium dodecylbenzenesulfonate | 1 g |
| Aqueous medium 7-4 | sodium dodecylbenzenesulfonate | 0.4 g |
| Aqueous medium 7-5 | AEROSOL OT | 0.4 g |

The grain size immediately after the preparation and the grain size after storage for 24 hours at 40° C. were measured. The results are shown in Table 6. The dispersions of the present invention were fine and showed excellent dispersion stability.

TABLE 6

| | Average particle size (μm) | |
|---|---|---|
| | Immediately after preparation | After 1 day storage at 40° C. |
| Comparison Dispersion 7-1 | 0.22 | 0.33 |
| Invention Dispersion 7-1 | 0.08 | 0.14 |
| Invention Dispersion 7-2 | 0.09 | 0.13 |
| Invention Dispersion 7-3 | 0.12 | 0.13 |
| Invention Dispersion 7-4 | 0.14 | 0.17 |
| Invention Dispersion 7-5 | 0.05 | 0.09 |

Example 8

Comparison Dispersion 7-1 or Invention Dispersion 7-4 prepared in Example 7 was used instead of ExY-2 at the 13th layer of sample 501 in Example 5. In detail, to the other coating ingredients that constituting the layer, Comparison Dispersion 7-1 or Invention Dispersion 7-4 was mixed by using a Sulver type SMX mixer, at the timing of 20 sec, 1 min, 5 min, 15 min or 30 min after its preparation, as shown in Table 7, to prepare respective coating compositions. The composition obtained by mixing 20 sec after preparation of the dispersion was prepared in-line manner. Thus-prepared coating compositions were coated after a residence time of 10 min, 20 min, 40 min, or one hour, to prepare samples 801 to 809 respectively, and exposure and development described in Example 5 were performed to the samples. The results are shown in Table 7. Silver halide light-sensitive materials, which attained the same sensitivity and graduation, as well as favorable granularity, sharpness, and color reproduction, by using relatively smaller amount of the compound, were obtained, when the coating compositions were prepared rapidly by using the dispersion according to the present invention, and thus-obtained compositions were coated within 20 min after the preparation.

TABLE 7

| | | Passage of time | | The amount of coupler |
|---|---|---|---|---|
| | Dispersion | Until preparation of coating composition | Until coating | required to obtain the same sensitivity and gradation as to Sample 801 |
| Sample 801 | Comparison Dispersion 7-1 | 30 min. | 1 hour | assumed to be 1 |
| Sample 802 | Comparison Dispersion 7-1 | 30 min. | 20 min. | 1 |
| Sample 803 | Invention Dispersion 7-4 | 20 sec. | 20 min. | 0.80 |

TABLE 7-continued

| | Dispersion | Passage of time: Until preparation of coating composition | Passage of time: Until coating | The amount of coupler required to obtain the same sensitivity and gradation as to Sample 801 |
|---|---|---|---|---|
| Sample 804 | Invention Dispersion 7-4 | 1 min. | 20 min. | 0.81 |
| Sample 805 | Invention Dispersion 7-4 | 5 min. | 20 min. | 0.85 |
| Sample 806 | Invention Dispersion 7-4 | 15 min. | 20 min. | 0.90 |
| Sample 807 | Invention Dispersion 7-4 | 20 sec. | 10 min. | 0.75 |
| Sample 808 | Invention Dispersion 7-4 | 20 sec. | 40 min. | 0.90 |
| Sample 809 | Invention Dispersion 7-4 | 20 sec. | 1 hour | 0.93 |

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for producing an aqueous dispersion of a water-insoluble photographically useful compound, which comprises mixing a composition containing at least one water-insoluble photographically useful organic compound, with an aqueous medium, and then dividing the water-insoluble photographically useful organic compound into particulates by a super-high-pressure homogenizer at 180 MPa (1800 bar) or higher.

2. The method for producing an aqueous dispersion of a water-insoluble photographically useful compound as claimed in claim 1, wherein the water-insoluble photographically useful compound is divided into particulates in a super-high-pressure jet stream.

3. The method for producing an aqueous dispersion of a water-insoluble photographically useful compound as claimed in claim 2, wherein an initial velocity of the super-high-pressure jet stream is 400 m/sec or higher.

4. The method for producing an aqueous dispersion of a water-insoluble photographically useful compound as claimed in claim 2, wherein an initial velocity of the super-high-pressure jet stream is 600 m/sec or higher.

5. The method for producing an aqueous dispersion of a water-insoluble photographically useful compound as claimed in claim 2, wherein the composition and the aqueous medium are mixed and dispersed in the jet stream.

6. The method for producing an aqueous dispersion of a water-insoluble photographically useful compound as claimed in claim 2, wherein the composition of the water-insoluble photographically useful compound is a molten product formed by mixing the water-insoluble photographically useful compound and a high-boiling organic solvent in the super-high-pressure jet stream, and dissolving the water-insoluble photographically useful compound in the high-boiling organic solvent.

7. The method for producing an aqueous dispersion of a water-insoluble photographically useful compound as claimed in claim 2, wherein the pressure for forming the jet stream is 210 MPa (2100 bar) or higher.

8. The method for producing an aqueous dispersion of a water-insoluble photographically useful compound as claimed in claim 2, wherein the pressure for forming the jet stream is 300 MPa (3000 bar) or higher.

9. The method for producing an aqueous dispersion of a water-insoluble photographically useful compound as claimed in claim 3, wherein the pressure for forming the jet stream is 300 MPa (3000 bar) or higher.

10. The method for producing an aqueous dispersion of a water-insoluble photographically useful compound as claimed in claim 4, wherein the pressure for forming the jet stream is 300 MPa (3000 bar) or higher.

11. The method for producing an aqueous dispersion of a water-insoluble photographically useful compound as claimed in claim 5, wherein the pressure for forming the jet stream is 300 MPa (3000 bar) or higher.

12. The method for producing an aqueous dispersion of a water-insoluble photographically useful compound as claimed in claim 1, wherein the aqueous dispersion of the water-insoluble photographically useful compound is substantially free from a water-miscible or low-boiling organic solvent, at a time immediately after completion of particulate formation step but before other subsequent steps.

13. The method for producing an aqueous dispersion of a water-insoluble photographically useful compound as claimed in claim 3, wherein the aqueous dispersion of the water-insoluble photographically useful compound is substantially free from a water-miscible or low-boiling organic solvent, at a time immediately after completion of particulate formation step but before other subsequent steps.

14. The method for producing an aqueous dispersion of a water-insoluble photographically useful compound as claimed in claim 1, wherein the melting point of a mixture of multiple water-insoluble photographically useful compounds, except for the high-boiling organic solvent and the dispersion aid, is lower by 2° C. or more than the mass weighted mean of the melting points of the respective compounds.

15. The method for producing an aqueous dispersion of a water-insoluble photographically useful compound as claimed in claim 1, wherein the aqueous medium contains a water-soluble protective colloid.

16. The method for producing an aqueous dispersion of a water-insoluble photographically useful compound as claimed in claim 1, wherein, after dividing the photographically useful compound into particulates, the aqueous dispersion prepared is mixed with an aqueous medium containing a water-soluble protective colloid.

17. The method for producing an aqueous dispersion of a water-insoluble photographically useful compound as claimed in claim 1, wherein the dispersion contains a surfactant.

18. The method for producing an aqueous dispersion of a water-insoluble photographically useful compound as claimed in claim 17, wherein the surfactant is used in an amount of 3% by weight or less, based on the water-insoluble photographically useful compound or a mixture of the compound and the high-boiling organic solvent.

19. The method for producing an aqueous dispersion of a water-insoluble photographically useful compound as claimed in claim 17, wherein the surfactant is used in an amount of 1% by weight or less, based on the water-insoluble photographically useful compound or a mixture of the compound and the high-boiling organic solvent.

20. The method for producing an aqueous dispersion of a water-insoluble photographically useful compound as claimed in claim 1, wherein the water-insoluble photographically useful compound is a coupler or a dye.

21. An aqueous dispersion of a water-insoluble photographically useful compound, wherein the dispersion is obtained by mixing a composition containing at least one water-insoluble photographically useful organic compound, with an aqueous medium, and then dividing the water-insoluble photographically useful organic compound into particulates by a super-high-pressure homogenizer at 180 MPa (1800 bar) or higher.

22. The aqueous dispersion of a water-insoluble photographically useful compound as claimed in claim 21, wherein an average particle size of the aqueous dispersion of the water-insoluble photographically useful compound is 0.01 $\mu$m or less.

23. The aqueous dispersion of a water-insoluble photographically useful compound as claimed in claim 21, wherein the water-insoluble photographically useful compound is a coupler or a dye.

24. A method for producing a molten product of a water-insoluble photographically useful compound, which comprises mixing and dissolving a water-insoluble photographically useful compound and a high-boiling organic solvent in a super-high-pressure jet stream.

25. A coating composition for use in a silver halide photographic light-sensitive material, which is prepared by utilizing an aqueous dispersion of water-insoluble photographically useful compound, wherein the aqueous dispersion of the water-insoluble photographically useful compound is obtained by mixing a composition containing at least one water-insoluble photographically useful organic compound, with an aqueous medium, and then dividing the water-insoluble photographically useful compound into particulates by a super-high-pressure homogenizer at 180 MPa (1800 bar) or higher.

26. A silver halide photographic light-sensitive material, which is prepared by utilizing an aqueous dispersion of water-insoluble photographically useful compound, wherein the aqueous dispersion of the water-insoluble photographically useful compound is obtained by mixing a composition containing at least one water-insoluble photographically useful organic compound, with an aqueous medium, and then dividing the water-insoluble photographically useful compound into particulates by a super-high-pressure homogenizer at 180 MPa (1800 bar) or higher.

27. A silver halide photographic light-sensitive material having at least one layer obtained by coating a coating composition, wherein the coating composition is prepared by (1) preparing an aqueous dispersion of an water-insoluble photographically useful compound in a manner mixing a composition containing at least one water-insoluble photographically useful organic compound, with an aqueous medium, and then (2) dividing the water-insoluble photographically useful organic compound into particulates by a super-high-pressure homogenizer at 180 MPa (1800 bar) or higher, and then mixing the dispersion rapidly after preparation with other coating ingredients.

28. The silver halide photographic light-sensitive material as claimed in claim 27, wherein the at least one layer of the coating composition is coated, on a support, without retention of time over 20 minutes from its preparation.

* * * * *